US008191982B2

(12) United States Patent
Brown et al.

(10) Patent No.: US 8,191,982 B2
(45) Date of Patent: Jun. 5, 2012

(54) LIQUID PROJECTION APPARATUS

(75) Inventors: Andrew Benjamin David Brown, Cambridge (GB); Paul Mark Galluzzo, Godmanchester (GB)

(73) Assignee: The Technology Partnership plc, Melbourn, Royston, Hertfordshire (GB)

( * ) Notice: Subject to any disclaimer, the term of this patent is extended or adjusted under 35 U.S.C. 154(b) by 122 days.

(21) Appl. No.: 12/445,034

(22) PCT Filed: Oct. 12, 2007

(86) PCT No.: PCT/GB2007/050625

§ 371 (c)(1),
(2), (4) Date: Aug. 9, 2010

(87) PCT Pub. No.: WO2008/044069

PCT Pub. Date: Apr. 17, 2008

(65) Prior Publication Data

US 2010/0294793 A1 Nov. 25, 2010

(30) Foreign Application Priority Data

Oct. 12, 2006 (GB) ..... 0620218.8
Oct. 12, 2006 (GB) ..... 0620219.6

(51) Int. Cl.
*B41J 29/38* (2006.01)
*B41J 2/45* (2006.01)

(52) U.S. Cl. ..... 347/11; 347/70

(58) Field of Classification Search ..... 347/11
See application file for complete search history.

(56) References Cited

U.S. PATENT DOCUMENTS

| | | | | |
|---|---|---|---|---|
| 4,167,742 | A * | 9/1979 | Head et al. | 347/44 |
| 5,831,650 | A * | 11/1998 | Reinten | 347/68 |
| 5,903,286 | A | 5/1999 | Takahashi | |
| 6,394,363 | B1 * | 5/2002 | Arnott et al. | 239/102.1 |
| 7,322,663 | B2 * | 1/2008 | Sanada | 347/10 |
| 2005/0035986 | A1 * | 2/2005 | Iwao et al. | 347/10 |
| 2005/0104913 | A1 * | 5/2005 | Sanada | 347/12 |
| 2006/0268033 | A1 * | 11/2006 | Satake | 347/10 |

FOREIGN PATENT DOCUMENTS

| | | |
|---|---|---|
| EP | 0752312 | 1/1997 |
| WO | 9310910 | 6/1993 |
| WO | 9954140 | 10/1999 |

* cited by examiner

*Primary Examiner* — Shelby Fidler
(74) *Attorney, Agent, or Firm* — Wong, Cabello, Lutsch, Rutherford & Brucculeri, L.L.P.

(57) ABSTRACT

A method of projecting liquid as jets or droplets from a nozzle provided on a transducer formed by a region of a material layer, the method comprising the steps of:

supplying liquid to an inner end of the nozzle;

exciting the nozzle to cause movement of the nozzle in a direction substantially aligned with the nozzle axis in order to project liquid as a droplet from an outer face of the nozzle;

wherein the step of exciting the nozzle comprises sequentially driving the transducer with a first rising voltage change, a first falling voltage change, a second rising voltage change and a second falling voltage change;

and wherein the first rising voltage change and the first falling voltage change are timed so that they enhance the movement of the material layer, and the second rising voltage change and the second falling voltage change are timed so that they substantially cancel the movement of the material layer.

17 Claims, 19 Drawing Sheets

Figure 1
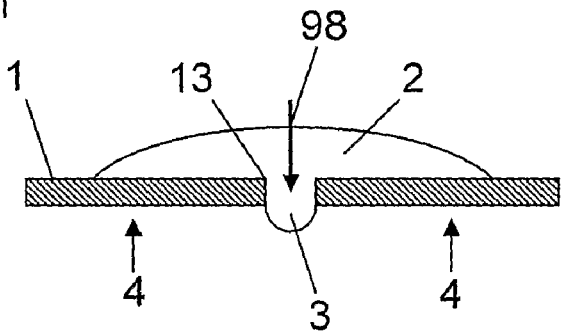
Figure 2
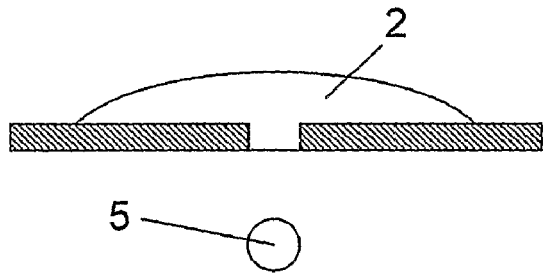
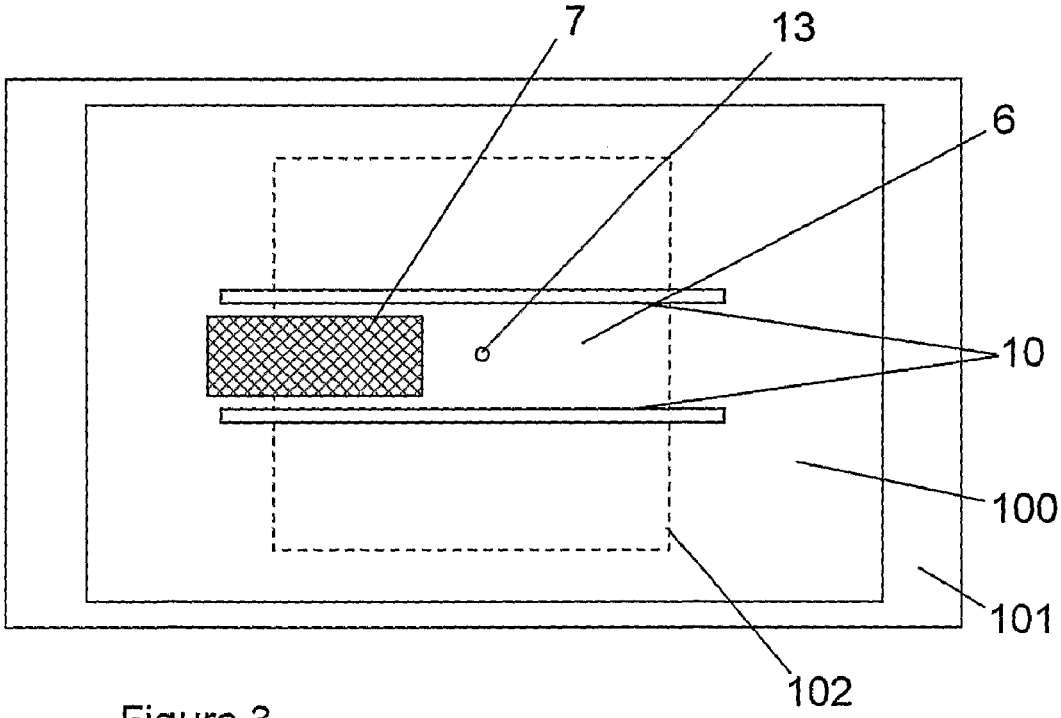
Figure 3

Figure 6a
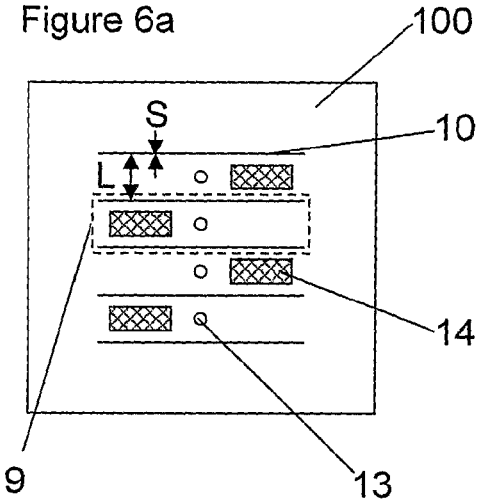
Figure 6b
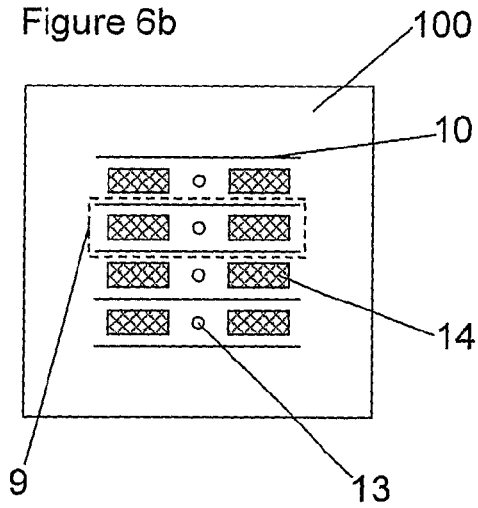
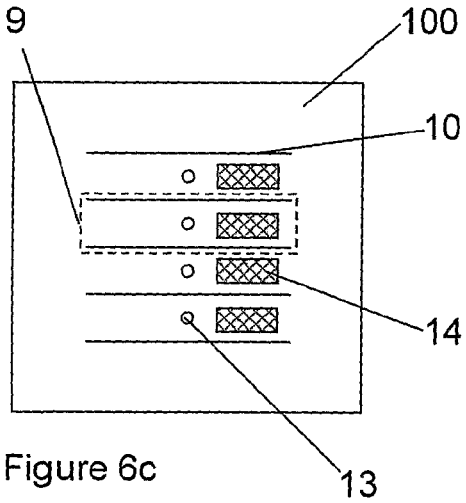
Figure 6c
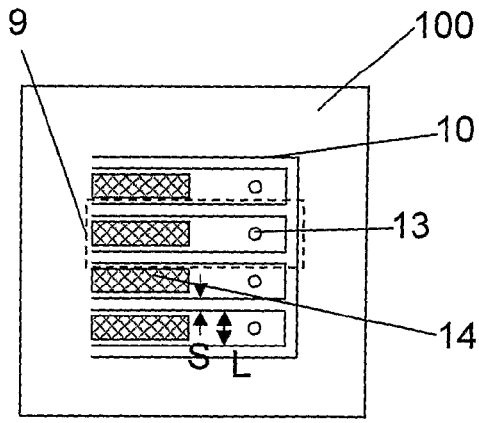
Figure 6d 44e
45e
44b
45b
44a
45a
45d
44d
45c
44c
400
Time
Amplitude of motion/signal 44e
46e
46b
44b
46a
44a
46d
44d
46c
44c
400
Time
Amplitude of motion/signal 44e
47e
47a
44a
47b
44b
47c
44c
47d
44d
400
Time
Amplitude of motion/signal 48a
48b
48c
48d
48e
48f
48g
48h
48i
400
Time
Amplitude of motion/signal

LIQUID PROJECTION APPARATUS

The present invention relates to a liquid projection apparatus in the form of what is known as a 'face-shooter' array.

In our previous application WO 93/10910 we describe a device for projecting droplets from a nozzle that is excited to project liquid therefrom.

In our previous application WO 99/54140 we describe a device and method for projecting liquid as jets or droplets from multiple nozzles formed in a material layer. The nozzles are formed in a transducer that incorporates a finger with liquid being supplied to an inner end of the nozzles. By continuously stimulating excitation of the finger motion at a certain frequency, the nozzle will eject a continuous droplet stream from an outer end of the nozzle.

Such devices as described above can be operated in a so called 'drop on demand' mode. A problem arises when the frequency at which drop on demand ejection can be made from a device is limited by the time it takes for the motion of the material layer to decay to a level where it does not significantly affect the next ejection.

U.S. Pat. No. 5,903,286 discusses how in order to avoid the above problem by applying pulse signals to an electrode of an ink channel. In this way, pressure waves in a liquid filled chamber behind the material layer can be cancelled. However, in the type of device described in WO 93/10910 and WO 99/54140 there is no local chamber and hence no reflected pressure waves of the type found in U.S. Pat. No. 5,903,286.

EP 0752312 describes an inkjet printhead that ejects ink by changing the volume in an ink channel such that an ink droplet is expelled from a nozzle. However, it does not describe ejecting droplets by exciting the nozzles themselves.

It is an aim of the present invention to increase the frequency at which ejection can occur by cancelling the residual motion in the material layer itself.

According to the present invention, there is provided a method of projecting liquid as jets or droplets from a nozzle provided on a transducer formed by a region of a material layer, the method comprising the steps of:

supplying liquid to an inner end of the nozzle;

exciting the nozzle with a transducer, to cause movement of the nozzle in a direction substantially aligned with the nozzle axis in order to project liquid as a droplet from an outer face of the nozzle;

wherein the step of exciting the nozzle comprises sequentially driving the transducer with a first rising voltage change, a first falling voltage change, a second rising voltage change and a second falling voltage change;

and wherein the first rising voltage change and the first falling voltage change are timed so that they enhance the movement of the material layer, and the second rising voltage change and the second falling voltage change are timed so that they substantially cancel the movement of the material layer.

By timing the voltage changes which excite the material layer, the movement of the material layer can be substantially cancelled. This allows droplets to be ejected at a higher frequency because the device is not limited by the time it takes for the motion of the material layer arising from a first ejection to naturally decay to a level where it does not significantly affect the second ejection.

Preferably, the movement of the material layer following any edge is mono-modal.

Preferably, the duration between the first rising voltage change and the first falling voltage change is half a period of the movement of the material layer.

Preferably, the midpoint in time between the first rising voltage change and the first falling voltage change is 1.5 periods of the movement of the material layer before the midpoint in time between the second rising voltage change and the second falling voltage change such that the combination of the voltage changes and the damping of the device substantially cancel the motion of the material layer.

Multiple re-inforcing voltage changes may be applied to cause ejection of a number of droplets, followed by multiple cancelling voltage changes to substantially stop the motion of the material layer.

Examples of the invention will now be described with reference to the accompanying drawings, in which:

FIG. 1 illustrates a cross-section of a device illustrating, in simplified form, the principle of operation whilst the material layer applies an impulse to the fluid;

FIG. 2 illustrates a cross-section of a device illustrating, in simplified form, the principle of operation after the material layer has applied an impulse to the fluid;

FIG. 3 illustrates a plan view of a first device;

Figure 7:
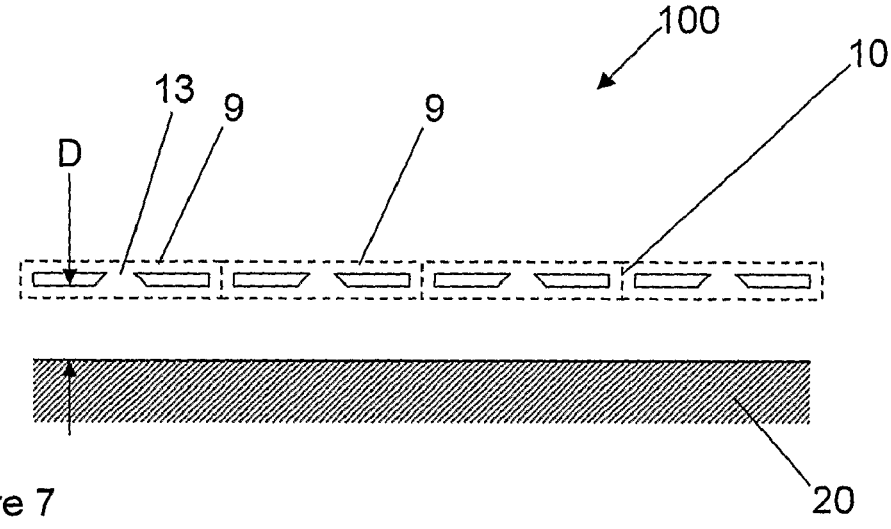
Figure 8A:
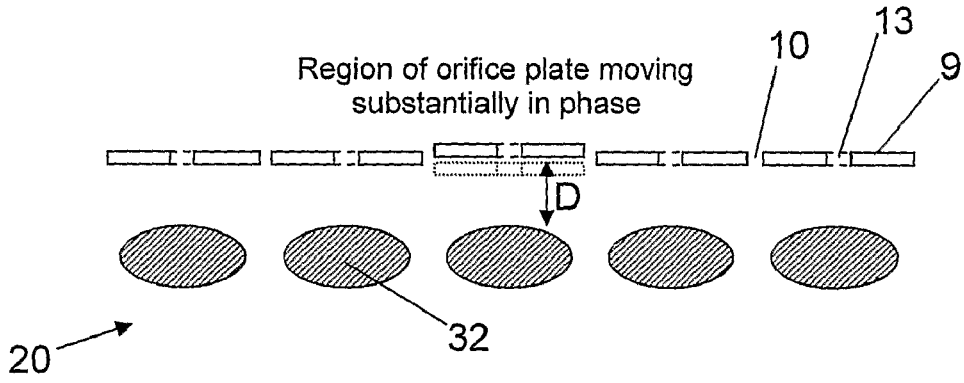
Figure 8B:
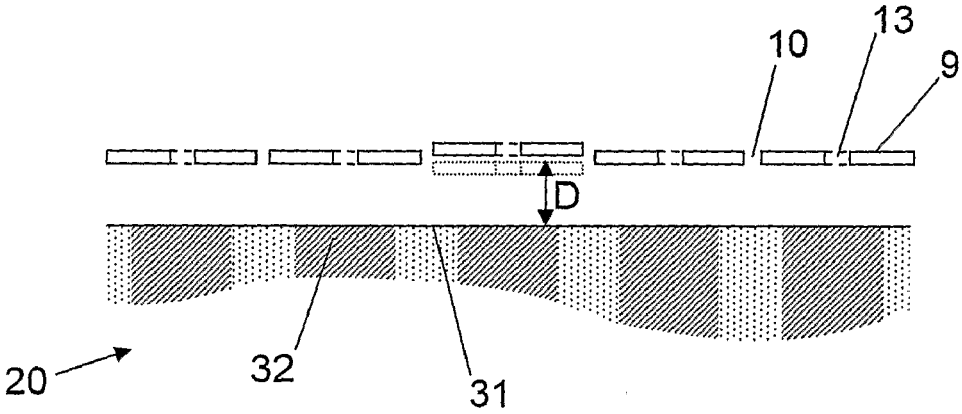
Figure 9A:
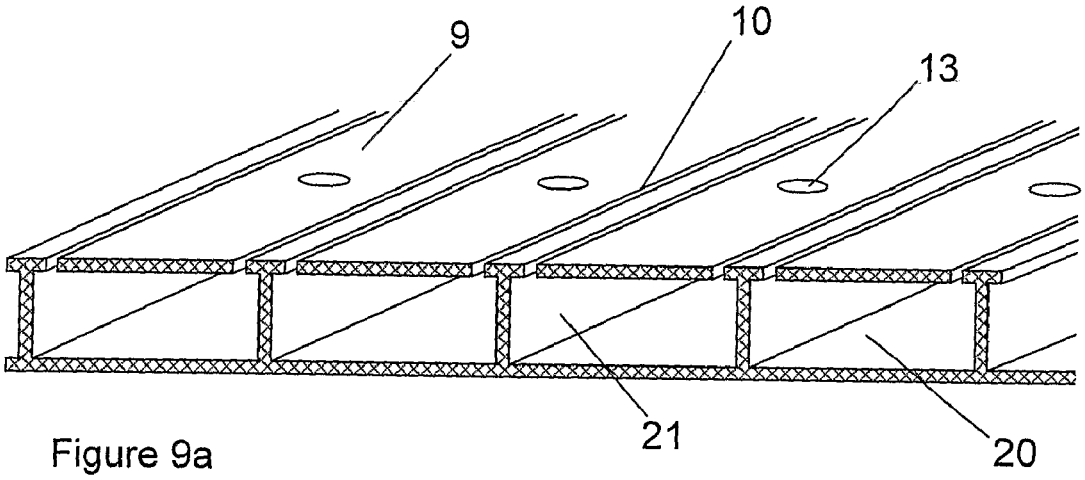
Figure 9B:
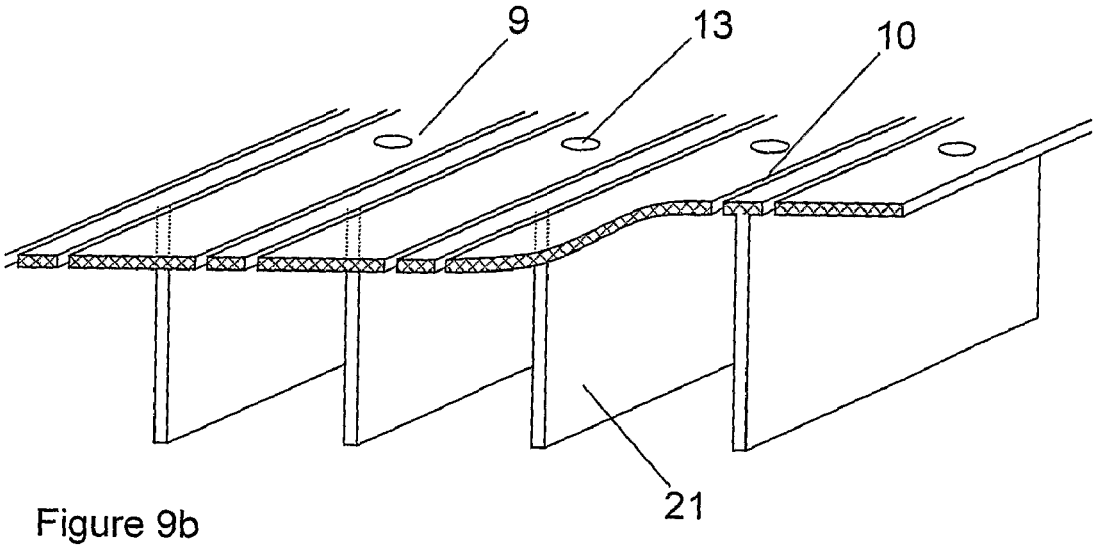
Figure 9C:
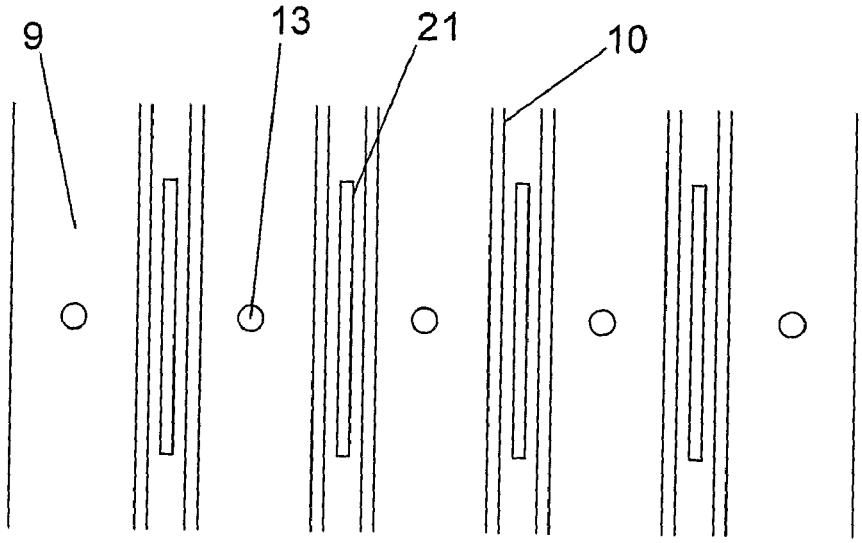
Figure 10A:
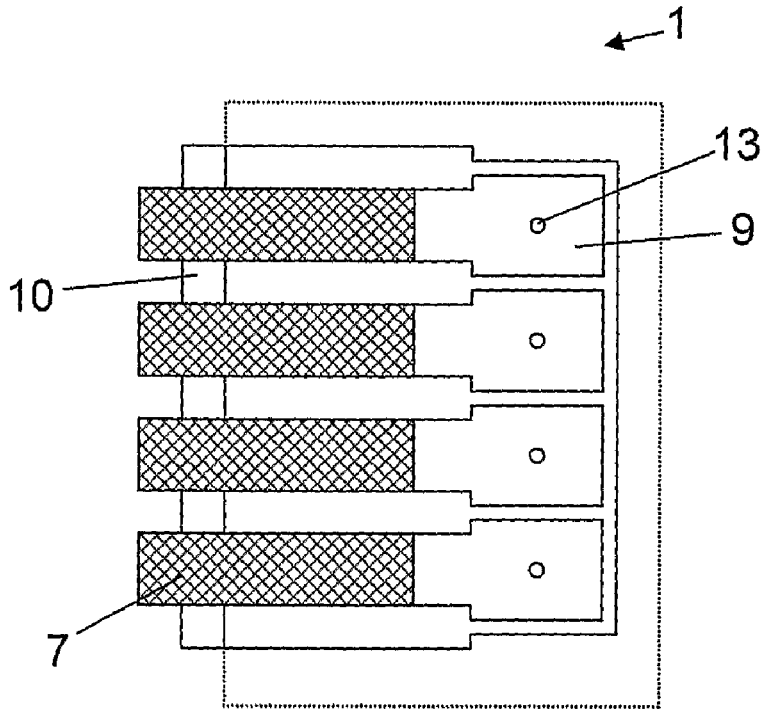
Figure 10B:
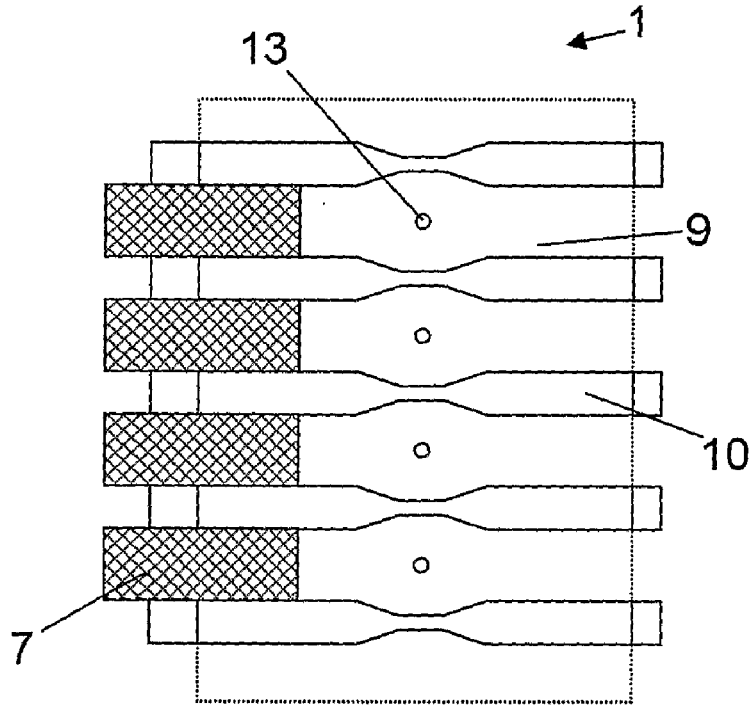
Figure 10C:
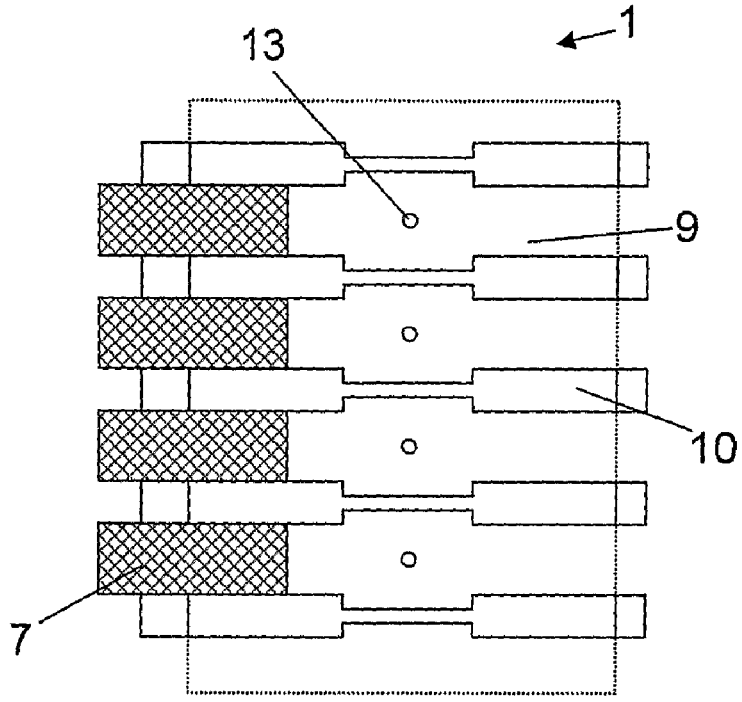
Figure 10D:
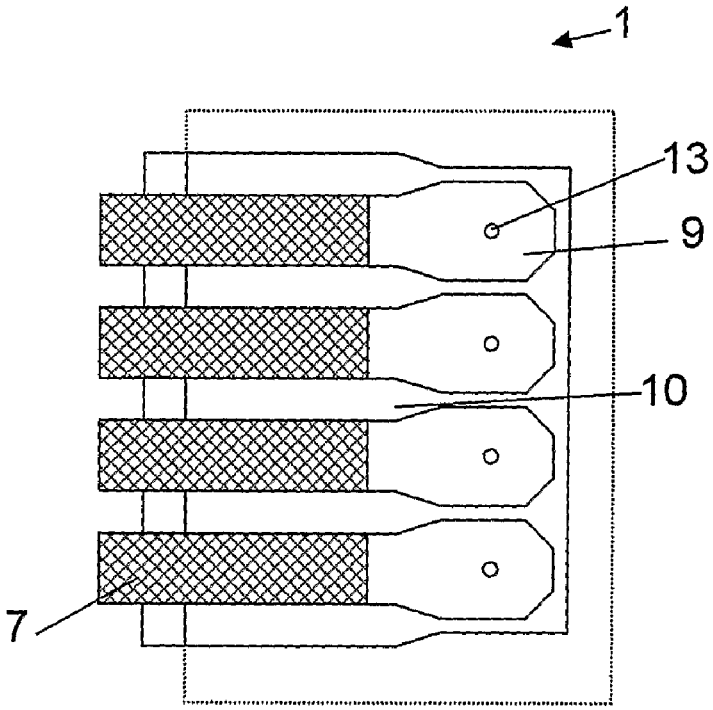
Figure 11:
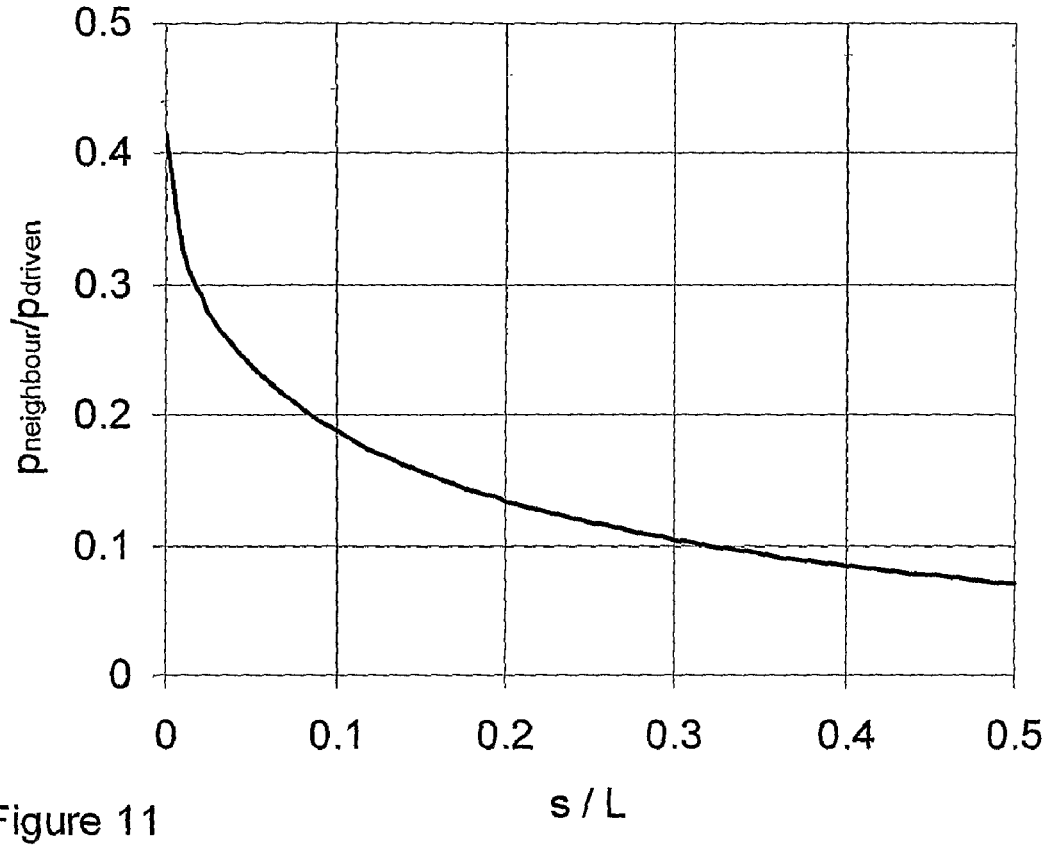
Figure 12:
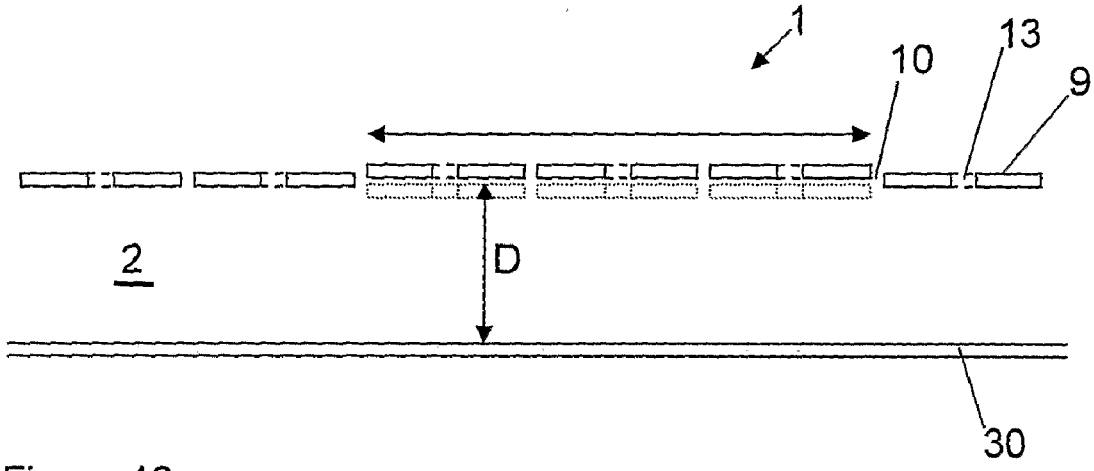
Figure 13A:
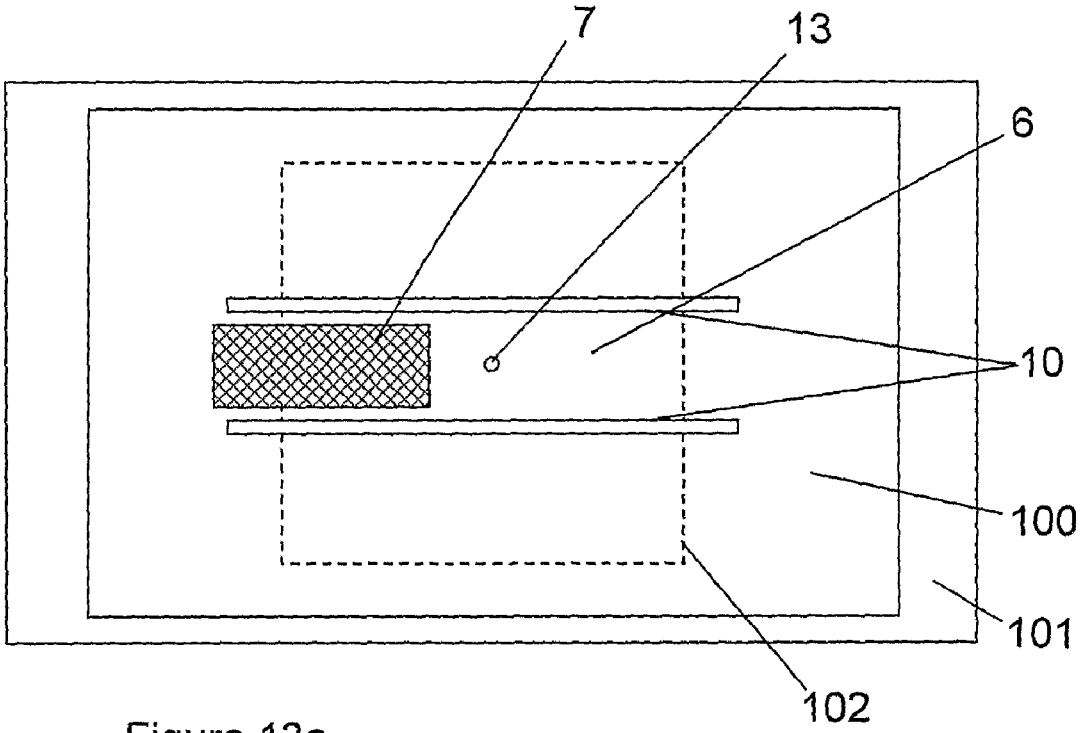
Figure 13B:
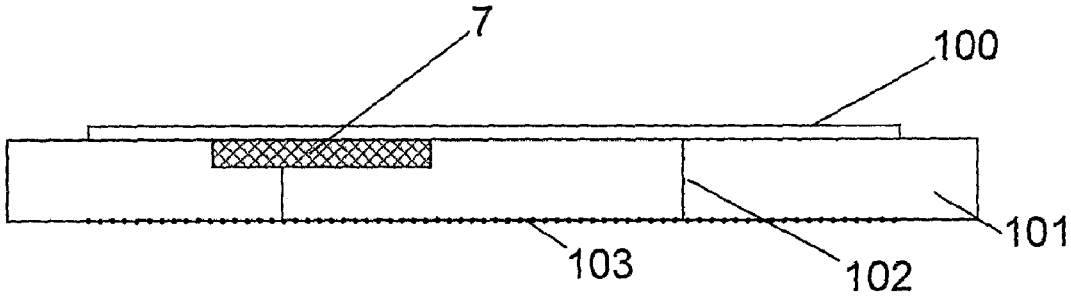
Figure 14:
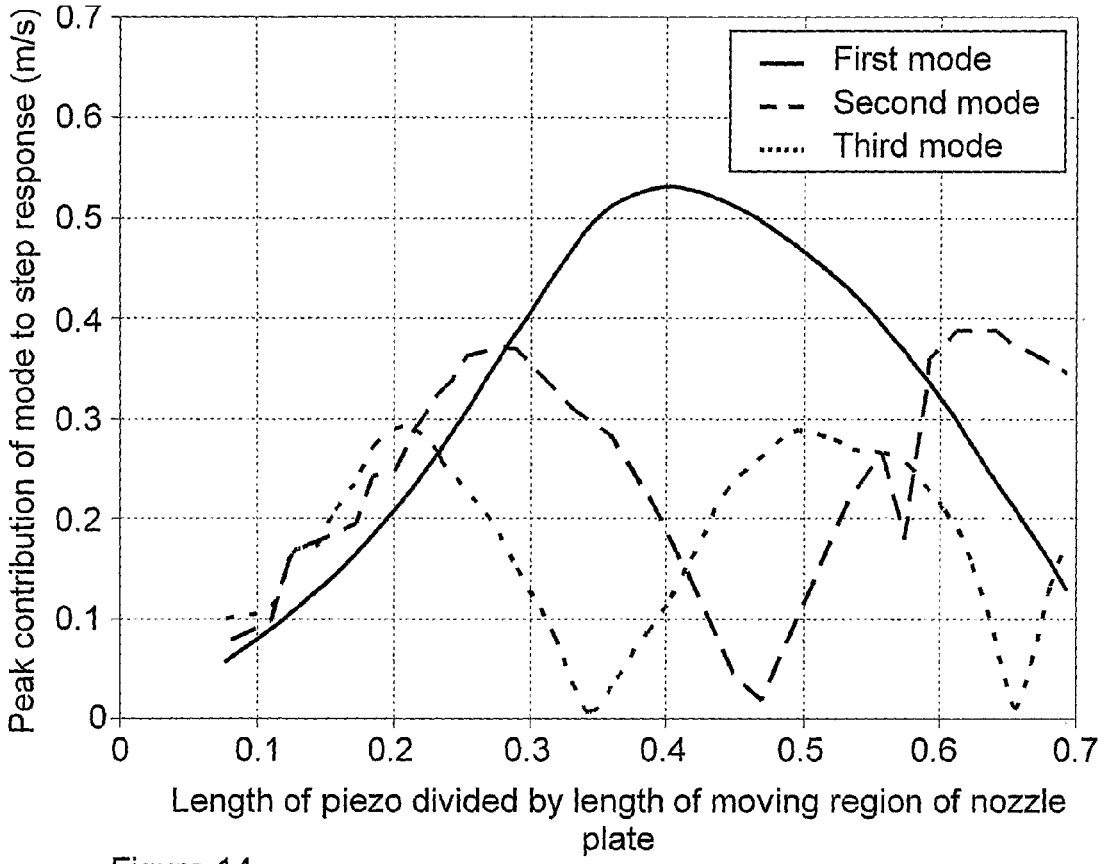

FIGS. 6 *a, b, c, d* illustrate plan views of four further examples;

FIG. 7 is a cross-section of the device, illustrating a rigid surface provided at the rear of the transducers;

FIG. 8*a* is a cross-section of the device, illustrating a patterned surface provided at the rear of the transducers;

FIG. 8*b* is a cross-section of the device, illustrating a surface with rigid and compliant surfaces provided at the rear of the transducers;

FIG. 9*a* is a cut-away isometric view of the device, illustrating rigid walls provided between adjacent transducers in combination with a rigid backplane;

FIG. 9*b* is a cut-away isometric view of the device, illustrating rigid walls provided between adjacent transducers;

FIG. 9*c* is a plan view of the device, illustrating rigid walls provided between adjacent transducers;

FIGS. 10*a-d* illustrate examples in plan view, of variation in slot width between transducers;

FIG. 11 illustrates the effect of altering the slot width between transducers;

FIG. 12 is a cross-section of the device, illustrating a compliant surface provided at the rear of the transducers;

FIG. 13*a* is a plan view of the device, illustrating a compliant surface provided at the rear of the transducers;

FIG. 13*b* is a cross-section view of FIG. 13*a*;

FIG. 14 shows the maximum velocity of the material layer due to the different resonant modes as a function of the length of the piezoelectric actuator.

Figure 15:
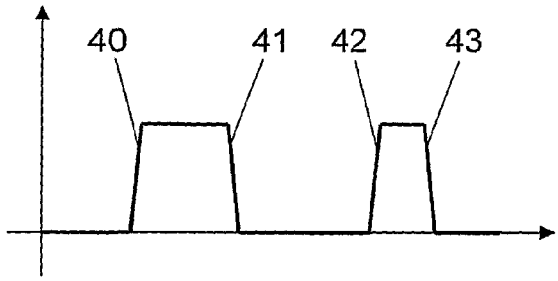
Figure 17:
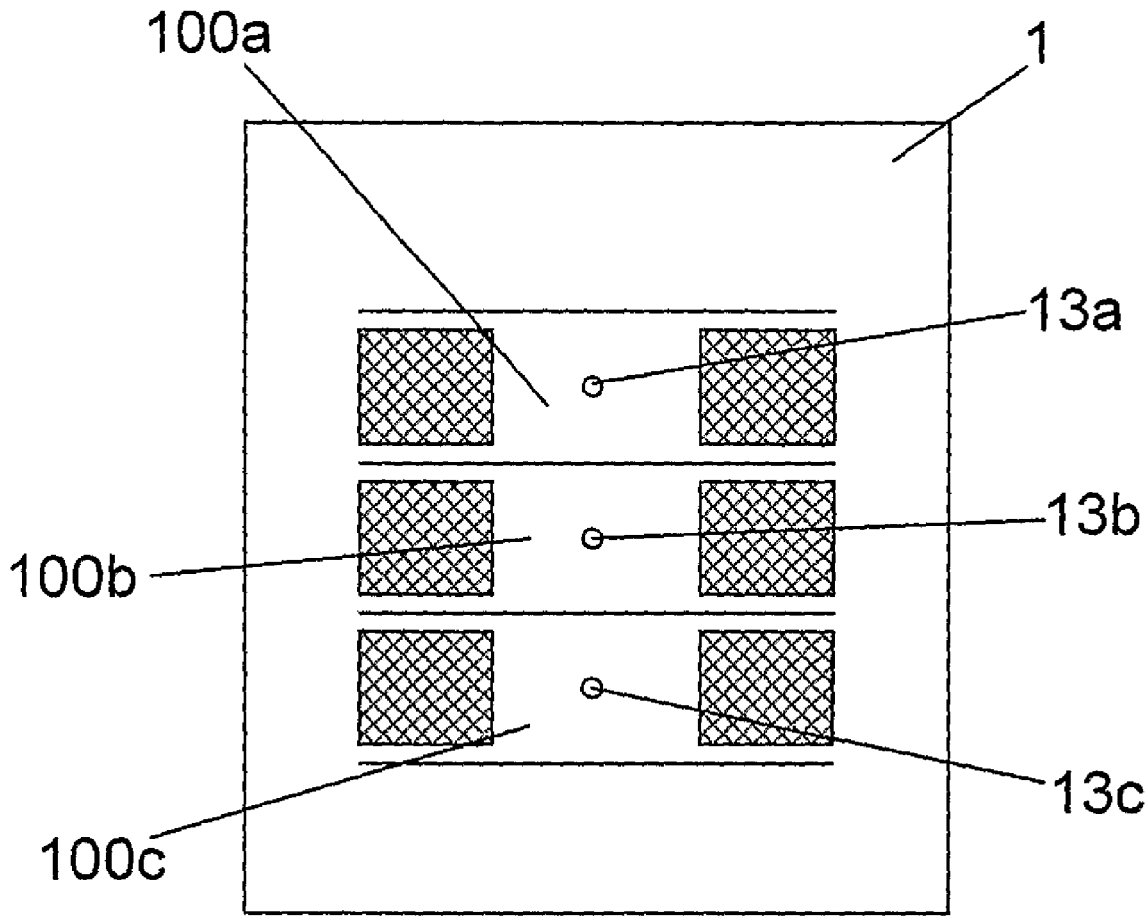

FIG. 15 illustrates drive signals applied to the actuator;

FIG. 16 *a-i* illustrates the effect of different drive signals on the motion of the material layer;

FIG. 17 illustrates a plan view of an example.

FIG. 1 shows a nozzle-bearing plate 1 formed in a material layer, containing a nozzle 13. An impulse applied to the fluid by the material layer shown at 4 induces positive pressure excursions in liquid 2 resulting in emergent liquid 3 through nozzle 13 in a direction shown at 98. FIG. 2 shows an emergent droplet 5 caused by the effects shown in FIG. 1. This, together with the ability of devices to provide pressure excursions of time duration in the region of one micro-second to one milli-second, advantageously allows liquid projection at very high frequencies.

One example embodiment, which has been reduced to practice, of a single transducer of the overall array device, is shown in plan view in FIG. 3. This illustrates a transducer incorporating a 'beam' or 'finger' 6, with, for example, one piezoelectric element 7 formed of PZT per nozzle 13. Nozzle 13 penetrates through material layer 100. This construction can provide a nozzle 13 mounted at the motional anti-node of the transducer, giving a symmetric pressure distribution in the sub-region of the nozzle. The transducer is distinctly formed, in this case, by the introduction of slots 10 into material layer 100, and by mounting the piezoelectric element 7 and material layer 100 assembly on a substrate 101 with a hole 102.

In this example as an operating liquid projection device, material layer 100 is electroformed Nickel of 60 microns thickness and bearing a nozzle of exit diameter 20 microns. The slots 10 were formed by electroforming and are of width 40 microns; the slot length is 6 mm, and the distance between the centres of adjacent slots 10 is 254 microns. The piezoelectric components 7 have width 214 microns, and are formed of piezoelectric ceramic 5H sourced from CTS providing high piezoelectric constants and mechanical strength. The electrode material applied to said piezoelectric components 7 was sputtered Nickel gold of thickness in the range 2-5 microns. In this example the piezoelectric material was mounted between the material layer 100 and the substrate 101. The material layer 100 was bonded to the piezoelectric material 7 and the piezoelectric material 7 was bonded to the substrate 101 using Epotek 353 supplied by Promatech. Electrical connections were made to the piezoelectric material 7 via the material layer 100 and the substrate 101.

By stimulating excitation with only one or a discrete number of such cycles the device ejects droplets 'on demand' i.e. responsive to that short droplet-projection pulse or pulse train, and ceasing after that pulse train ceases. The device described above was operated with a drive voltage of 100V peak to peak and with a base frequency of 46.6 kHz. This device yielded a maximum 'on-demand' ejection frequency of 10 kHz. With other devices of this general form, on-demand ejection has been observed with a drive voltage of 40V peak-to-peak. The electrical signals required to drive the device can be derived from a number of means such as an array of discrete device drivers or from an ASIC.

This liquid projection apparatus whose fabrication was described above was mounted onto a manifold to provide liquid supply means and in proximity to printing media to form a system suitable for ink-jet printing. Using water-based ink, at a supply bias pressure from 0 to 30 mbar below atmospheric pressure, the device was demonstrated operating in drop on demand mode. It was found experimentally that no sealant was needed in order to prevent egress of fluid from the slots.

Figure 4:
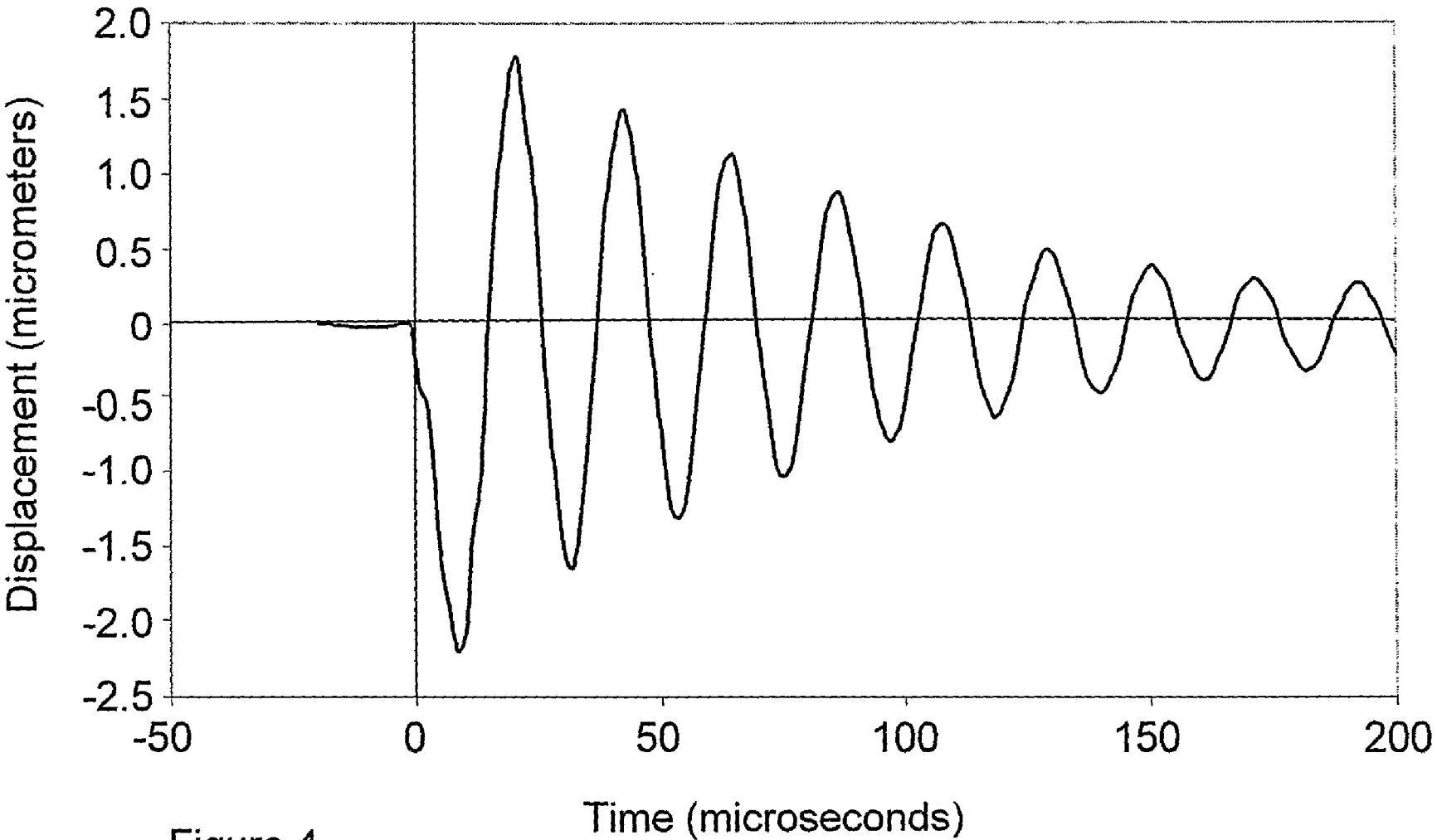
FIG. 4 shows experimental data of the motion of a device following a 10 microsecond pulse applied at time=0.

The experimental measurement of the motion of the device of FIG. 3 following a 10 microsecond pulse is shown in FIG. 4. The motion is dominated by one mode with a characteristic frequency of 46.6 kHz.

Figure 5:
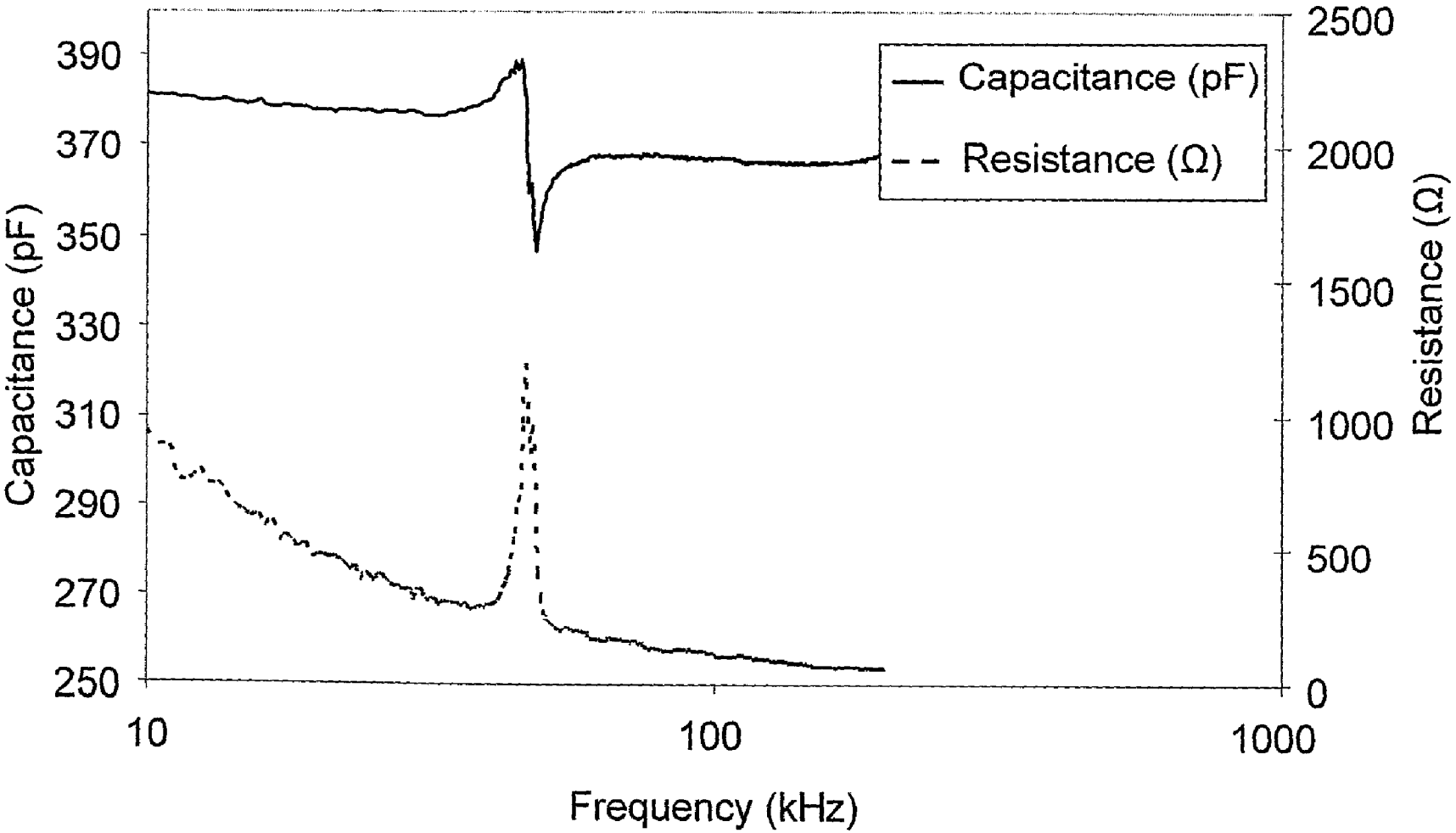
FIG. 5 illustrates a graph of an experimental frequency response function of the first device.

FIG. 5 shows the result of experimental measurement of the electrical impedance using a HP 4194 impedance spectrometer. The frequency sweep runs from 10 kHz to 200 kHz, and shows that the only resonance in this range is the peak centred at 46.6 kHz. It also shows the absence of unwanted vibrational modes near to the desired operating frequency.

In alternative constructions for the example of FIG. 3, unimorph (single layer) and bimorph (double layer) or multilayer geometries may be employed for the excitation means shown at 7. The thickness of the region of material layer material 100 near the ends of the slots, and the dimensions of the excitation means material 7 are chosen to control the resonant frequency of the device.

Being substantially isolated by slots 10 and by the substrate 101, arrays of such transducers allow substantially independent control of drop ejection from an array liquid projection device such as an ink-jet printhead.

FIGS. 6*a*, 6*b*, 6*c* and 6*d* illustrate optional constructions wherein multiple nozzle-bearing transducers 9 are formed within the material layer 100, their lateral extent being defined by the slots 10. Each such transducer bears a nozzle 13 through layer 100. FIGS. 6*a*, 6*b*, 6*c* and 6*d* differ in that they illustrate a variety of permutations of excitation means configuration 14, as shown.

The "characteristic dimension of the material layer" is defined as the smallest dimension of a region of the material layer, which is normal to the direction of nozzle motion, which is moving substantially in phase.

In an example of the device type such as those illustrated in FIG. 5, the characteristic dimension of the material layer is the width of the moving portion of the material layer 100, 214 μm. The dimensions of the common region behind the material layer 100 is 25 mm depth of fluid behind the material layer 100, 2.8 mm in a direction in the plane of the material 100 and substantially parallel to the slots 10, and 36.6 mm in a direction in the plane of the material layer 100 and substantially perpendicular to the slots 10. This device exhibits ejection for a range of fluid viscosities from 0.5 cp to 300 cp.

A rigid surface 20 may be provided substantially parallel to the moving material layer 100 and at a distance D behind the inner face of the moving material layer as shown in FIG. 7. For a given motion of the material layer the impulse applied by the material layer to the fluid is increased by the presence of a rigid surface 20.

As noted above, pressure is generated in the fluid through the impulse of the moving material layer. By increasing the impulse applied to the fluid, for a given motion of the material layer, the rate of fluid flow through the nozzle 13 is increased. Therefore, increasing the impulse applied to the fluid by the material layer for a given motion of the material layer reduces the motion of the material layer that is required in order to eject liquid droplets.

In order to increase the impulse applied to the fluid by the material layer, the distance D should be comparable to or smaller than the characteristic dimension of the material layer, L.

Without the rigid surface 20, or with a rigid surface 20 at a distance D from the material layer where D>>L, for example D ten times greater than L, the pressure behind the material layer is proportional to the characteristic dimension L of the material layer. When a rigid surface 20 is placed at a distance D from the material layer where D is much less than L, for example D equal to half L or less, then the pressure generated by motion of the material layer is proportional to $L^2/D$. At intermediate distances the pressure generated by the same motion of the material layer will vary with L in a manner between L and $L^2/D$.

In a second example, the rigid surface 20 is patterned as shown in FIG. 8*a*. This allows the impulse applied to the fluid by the material layer to be increased behind each nozzle for a given motion of the material layer, thereby reducing the motion of the material layer required for ejection. In addition, this example is advantageous because the gaps in the rigid backplane reduce fluidic crosstalk between the nozzles 13.

Crosstalk can be defined as being the amount that an ejection event is changed (typically a change in the velocity or volume of an ejected drop) by the presence of an ejection event from a neighbouring nozzle. Consider two adjacent independently actuated regions of material layer each with a nozzle 13, material layer region A and material layer region B. If material layer region B is driven in isolation with fixed drive conditions, pressure is generated behind material layer region B to cause ejection. If both material layer regions A and B are simultaneously driven to cause ejection, then the pressure under both material layer regions A and B will be changed slightly by the motion of the adjacent material layer region compared to that when they are driven in isolation. This small pressure change behind each material layer region results in a change in the drop volume and/or drop velocity of the drop ejected by each material layer region compared to that when it is driven alone. This change is the crosstalk between material layer region A and material layer region B. The crosstalk will thus be reduced if the ratio of the pressure generated behind material layer region B due to the motion of material layer region B to the additional pressure generated behind material layer region B due to the motion of material layer region A is increased. Placing a rigid surface behind each material layer region A and B increases the pressure behind material layer region B due to the motion of material layer region B. The pressure behind region B is increased by a larger ratio than the increase in the additional pressure behind material layer region B that results from the motion of material layer region A. This is a result of the additional pressure generated being dissipated in the gaps between the rigid surfaces. Thus placing a rigid surface behind each material layer region reduces the fluidic crosstalk.

In a third example shown in FIG. 8*b*, compliant surfaces 31 are provided between the sections 32 of patterned rigid surface 20. The patterned sections of rigid surface 20 act to increase the pressure behind a nozzle 13, thereby reducing the motion of the transducer 9 required for ejection, and the compliant surfaces 31 act to reduce crosstalk.

Rigid side walls 21 can also be placed, between the transducers, extending along the length of the transducer, as illustrated in FIG. 9*a*. The walls also act to reduce fluidic crosstalk between nozzles as they reduce the amount of pressure that is transmitted from the fluid beneath an actuated nozzle 13 to the region of fluid behind a neighbouring nozzle 13. The walls may be of limited length, as shown in FIG. 9*b* and in plan view in FIG. 9*c*, the length of the walls being always preferably greater than the distance between the walls, and more preferably greater than two times the distance between the walls. The walls 21 do not have to be connected to the rigid surface 20, although they are shown connected in FIG. 9*a*.

The rigid side walls 21 may also be placed without the rigid surface 20 as shown in FIG. 9*b*. In this case the height of the walls is preferably greater than the distance between the walls and more preferably greater than two times the distance between the walls.

In order not to introduce mechanical crosstalk between adjacent transducers, the rigid walls are isolated from the material layer, i.e. they are not mechanically engaged with the material layer.

The rigid surface 20 and side walls 21 do not form a chamber that contains the ink, as the ink is still free to flow in the direction that is not bounded by any walls or surfaces. For example, in FIG. 9*a*, the ink is constrained in a vertical direction and a horizontal direction with the page, but the ink is not constrained in a direction out of the page.

The width of the slot 10 between adjacent transducers 9 can be varied along the length of the transducer as shown in FIGS. 10*a-d*. In the particular examples shown in FIG. 10*a-d*, the width of the slot 10 between two adjacent transducers 9 is greater at a distance away from the nozzle 13 than the width of the slot adjacent the nozzle.

By increasing the slot width in some regions along the length of the slot 10, spatial crosstalk is reduced between the transducers. It is desirable to reduce crosstalk so that the motion of one nozzle-bearing transducer 9, when excited to eject liquid from its associated nozzle 13, does not cause substantial pressure fluctuations in liquid that is adjacent to nozzle-bearing regions of other transducers. The definition of crosstalk is discussed in relation to FIG. 8.

The pressure that is transmitted, by a moving material layer region to the fluid behind a neighbouring material layer region, is reduced by the action of the air liquid interface in the slot, which acts as a pressure absorbing surface. By increasing the width of the slot 10 between two neighbouring material layer regions, the amount of pressure absorbed by the air liquid interface is increased. The pressure absorbing surface could also be a surface that has a low bending stiffness and low inertia and is therefore able to respond during the time scale with which the pressure in the fluid is created and removed, thus absorbing some of the pressure. For instance, the slot could be covered with a compliant membrane.

In the examples shown in FIGS. 6*a-d* where the width of the moving material layer region is much smaller than the length of the transducer, the pressure under a material layer region, which neighbours a driven moving material layer region, depends on the width of the finger (L) and the width of the slot (s) as shown in FIG. 11. Spatial crosstalk is minimised when the ratio of the pressure at the neighbouring nozzle to the pressure at the driven nozzle is as low as possible ($P_{neighbour}/P_{nozzle}$). As can be seen in FIG. 11, it is therefore desirable that the ratio of s/L is a large as possible.

It is not so advantageous simply to increase the width of the slot along the whole length of the transducer as this will also narrow the finger width. A narrow finger means that the motion required for ejection is increased. Therefore, the slots are widened at a distance away from the nozzle as illustrated in FIG. 10*a-d* in order to reduce the nearest neighbour crosstalk and significantly reduce the next nearest neighbour crosstalk while not significantly increasing the motion required for ejection.

As illustrated in FIG. 12, a compliant surface 30, substantially parallel to the nozzle-bearing plate 1, can be provided at a distance D from the transducers 9. This surface will reduce both the pressure induced in the fluid 2 behind the transducers and the region over which that pressure is significant, if the distance D is comparable to or less than the minimum dimension of the area of material layer that is moving substantially in phase. The area of the material layer that is moving substantially in phase is illustrated by a horizontal arrow in FIG. 12. In this Figure, three transducers are moving substantially in phase.

The amount of pressure that is transmitted through the fluid behind the transducers 9 is reduced because the compliant surface 30 acts as a pressure absorbing surface.

A compliant surface is defined as a surface that will move in response to the pressure induced in the fluid on a timescale sufficiently short that it significantly reduces the pressure in the fluid next to the compliant surface compared to the pressure at that point when the compliant surface is replaced with a bulk region of fluid. The compliant surface 30 could be a compliant membrane, with air behind it, or it could be a soft foam, or it could be a liquid air interface.

One example of a compliant surface as part of an ejecting device is shown in FIGS. 13*a* and 13*b*. This illustrates a compliant surface composed of an interface between air and fluid. The interface is supported by a fine mesh 103 (for example a steel mesh) that is placed behind the array of fingers 6.

In this example the device is similar in construction to that shown in FIG. 2 except that it also includes a mesh 103 that is clamped onto the back of the substrate 101. The fluid is fed into the hole in substrate 101 between the material layer 100 and the mesh. The distance between the mesh 103 and the material layer 100 is 400 micrometers.

In a further example shown in FIG. 8*b*, patterned compliant surfaces 31 are provided behind the nozzle-bearing plate 1. Between the compliant surfaces 31, behind the centres of the regions of the transducers 9 that can be independently moved, are provided rigid surfaces 32. The rigid surfaces 32 act to increase the pressure behind a nozzle 13, thereby reducing the amplitude of the transducer 9 required for ejection, and the compliant surfaces 31 act to reduce crosstalk.

The frequency at which drop on demand ejection can be made from a device is limited by the time it takes for the motion of the ejection system to decay to a level where it does not significantly affect the next ejection. If a device is made so that its motion is primarily mono-modal following a single voltage change, the motion can be built up and then cancelled by applying voltage changes at suitable times. Thus a lower voltage can be used to achieve a desired amplitude of motion and this motion can be stopped allowing the drop on demand frequency to be increased. If the device is not mono-modal and so energy is transferred into other modes then, in general, it is not possible to construct a signal that will successfully cancel the motion of the device in a small number of cycles of the dominant mode.

The device can be described as mono-modal when, following a single voltage change, the maximum velocity of the material layer due to the first order mode is significantly larger than the maximum velocity of the material layer due to higher order modes. Preferably the initial velocity of the device due to the first order mode is more than twice the velocity due to higher order modes. More preferably it is greater than four times the velocity due to higher order modes. This can be achieved by selecting a suitable ratio between the length of the piezoelectric actuator and the transducer length.

For example consider the device shown in FIG. 2 with a 60 micron thick electroformed material layer and 100 microns thick bulk cut piezoelectric actuator. FIG. 14 shows the maximum velocity of the material layer due to each of the first, second, and third order modes as a function of the fractional length of the piezoelectric actuator as a proportion of the length of moving material layer, following a single voltage change for devices with resonant frequency of 50 kHz. This shows clearly that the ratio between the velocity from the first order mode and the velocity from the higher order modes is a maximum at around a piezoelectric actuator length fraction of 0.4. For the particular materials used, this length of the moving piezoelectric actuator in this device is 1.2 mm and the transducer length is 2.8 mm. In practice it may be desirable to vary the dimensions slightly from this ideal according to which particular higher order modes affect the motion of the material layer most strongly immediately beside the nozzle.

In order to drive such a device, rising and falling voltages are applied that reinforce the motion and thus reduce the voltage that is required to achieve a given amplitude. These voltage changes can be used to produce motion that cause one, two or many drops to be ejected. Following the ejection of the last drop that is required, the motion of the device can be stopped or significantly reduced by applying one, two or more voltage changes that are timed so as to cancel the motion of the device. This is desirable for two reasons. Firstly the frequency at which drop on demand ejection can be made from a device can be increased, as active motion cancellation can be achieved more rapidly than allowing the motion to decay to a level where it does not significantly affect the next ejection. Secondly if the motion of the device is not significantly reduced by applying a suitable signal then the ensuing motion may cause undesired drops to be ejected.

One example of such a drive scheme is shown in FIG. 15. The drive scheme consists of two pulses of equal voltage. The first voltage rise 40 and the first voltage drop 41 enhance the motion of the transducer 9 and the second voltage rise 42 and the second voltage drop 43 are designed to cancel that motion.

Because the device is mono-modal, the further voltage changes 42 and 43 can be applied to cancel the motion of the device. Such active cancellation of the motion reduces or removes motion of the material layer in substantially less time than would be the case if the motion is simply allowed to decay. This significantly reduces the delay time before a further series of voltage changes can be applied to initiate the next ejection event. With this drive scheme the drop on demand ejection frequency can be increased to up to a half of the resonant frequency of the device for ejection where the motion of the transducer is cancelled prior to initiating the motion required to eject the next droplet.

FIGS. 16*a-e* illustrate the effect of changing the timings between the four voltage changes. The material layer has a resonant frequency and associated period p and this is shown by line 400 in FIG. 16 for illustration only.

Figure 16A:
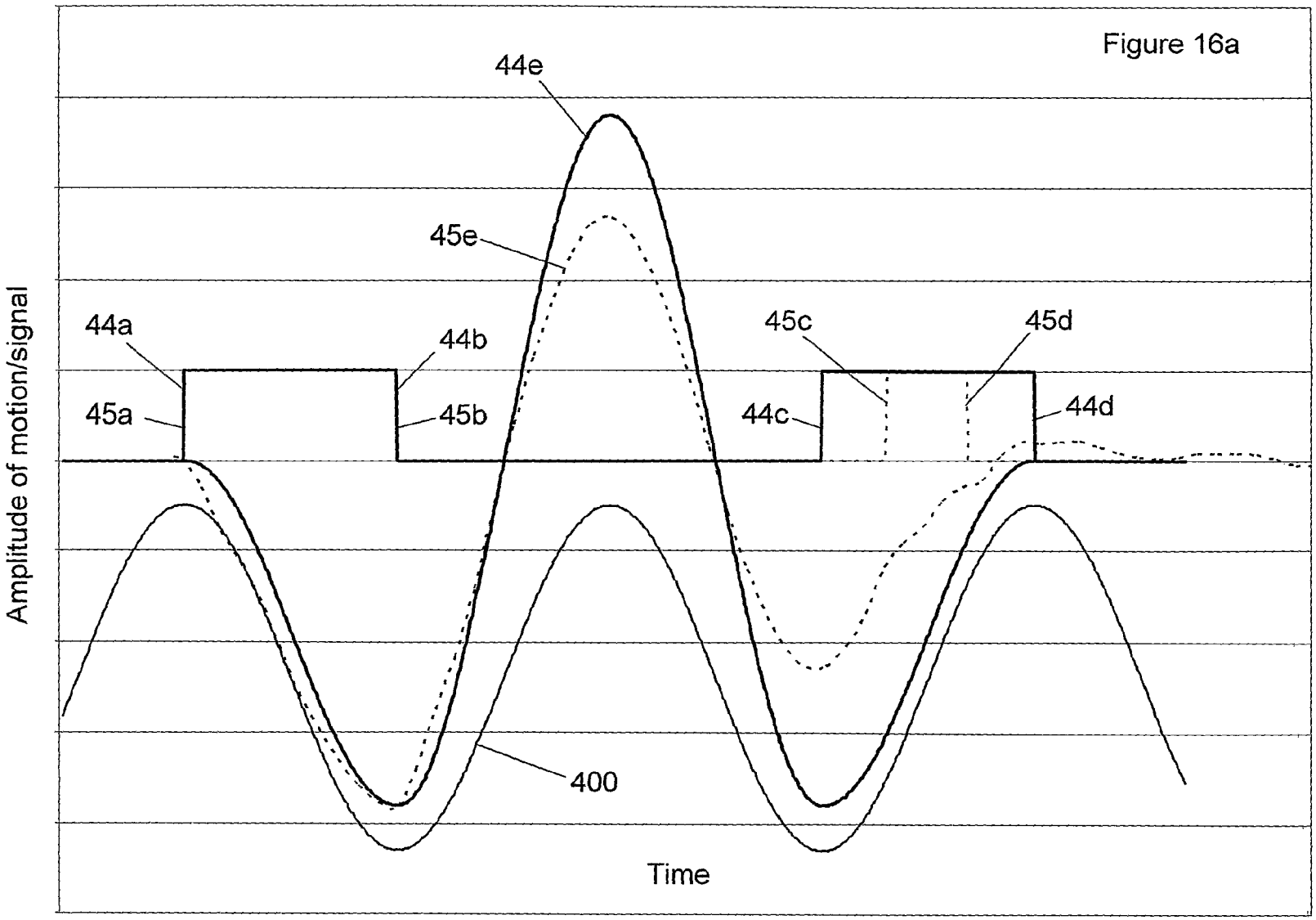

In a preferred embodiment, a first falling voltage change 44*b* is timed to be a time p/2 after the first rising voltage change 44*a* so that the motion from these two voltage changes is reinforced. The motion of the material layer will be stopped if the following two conditions are met. The first condition is that the midpoint in time between the second rising voltage change 44*c* and the second falling voltage change 44*d* is 1.5 periods of the movement of the material layer after the midpoint in time between the first rising voltage change 44*a* and the first falling voltage change 44*b*. The second condition is that the second falling voltage change 44*d* is placed at a suitable time after the second rising voltage change 44*c*. In the theoretical case of a device with insignificant damping, the second falling voltage change 44*d* should be placed at a time p/2 after the second rising voltage change 44*c* in order to cancel the motion, as in the case of a device with insignificant damping, the motion of the material layer will continue with no decay of motion until the third and fourth voltage changes, This is illustrated in FIG. 16*a* by line 44*e* showing the motion of an undamped device, where the motion is cancelled when the second rising and falling voltage changes are applied.

In a device where damping is significant, the time between the second rising voltage change 44*c* and the second falling voltage change 44*d* needs to be altered in order to cancel the motion of the material layer. In particular, the gap between the second rising voltage change 44*c* and the second falling voltage change 44*d* must be increased or decreased to detune these edges to compensate for the amplitude already lost owing to the damping of the material layer.

The damping causes a reduction in amplitude with time, and whilst in order to induce the maximum motion to the material layer the first rising voltage change will occur at time t=0 and the first falling edge should still occur at t=p/2, in the same way as an undamped device, the second rising voltage change and second falling voltage change are at t >3p/2 and t<2p respectively or at t<3p/2 and t>2p respectively to compensate for the fact that the induced motion has been reduced by the damping. The case where the second rising voltage change and second falling voltage change are at t>3p/2 and t<2p respectively is illustrated in FIG. 16*a* by first rising voltage change 45*a*, first falling voltage change 45*b*, second rising voltage change 45*c* and second falling voltage change 45*d*. These voltage changes result in a response from the material layer shown in line 45*e*.

Figure 16B:
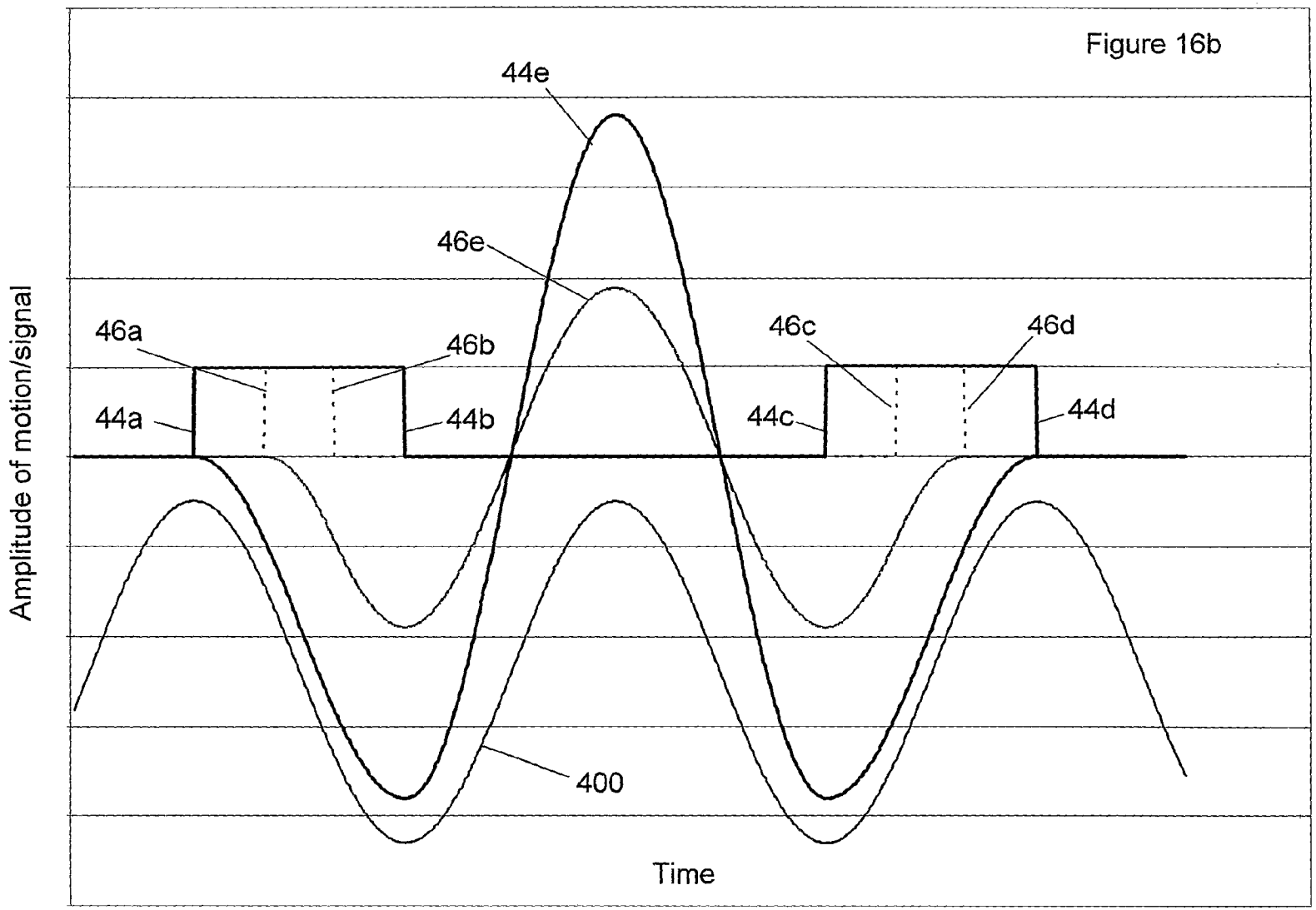

It is also possible to reduce the amplitude of motion of the material layer by increasing or decreasing the time between the first two voltage changes 40 and 41. FIG. 16*b* illustrates the affect of changing the timings of the first rising and first falling voltage changes. FIG. 16*b* illustrates a device where the damping is insignificant, i.e. a theoretical device.

In FIG. 16*b*, the theoretical motion of an undamped device is shown in line 44*e* which is produced by voltage changes 44*a*, 44*b*, 44*c* and 44*d*, as described with reference to FIG. 16*a*. When the voltage changes 44*a*, 44*b*, 44*c* and 44*d* are applied at the times shown in FIGS. 16*a* and 16*b* as described above, a maximum amplitude of motion of the material layer will be achieved. In order to reduce the motion of the material layer to say 50% of the maximum amplitude, after applying a first rising voltage change 46*a*, a first falling voltage change 46*b* is placed after the first rising voltage change at a time less than half the resonant period p of the material layer (i.e. the time between voltage changes 46*a* and 46*b* is less than the time between voltage changes 44*a* and 44*b*). As can be seen from FIG. 16*b*, this results in motion of the material layer shown in line 46*e* which has a smaller amplitude than that shown in line 44*e*. To achieve a 50% reduction in amplitude of the material layer, the first falling voltage change occurs at approximately one sixth of a resonant frequency period after the first rising edge.

The motion of the material layer represented by line 46*e* can be cancelled as described above, by applying a second rising voltage change 46*c* and a second falling voltage change 46*d*. The second rising voltage change occurs at one and a half resonant periods after the first voltage change 46*a*, and the second falling voltage change 46*d* occurs at the same time interval after the second rising voltage change 46*c* as the time period between the first rising 46*a* and falling 46*b* voltage changes.

Figure 16C:
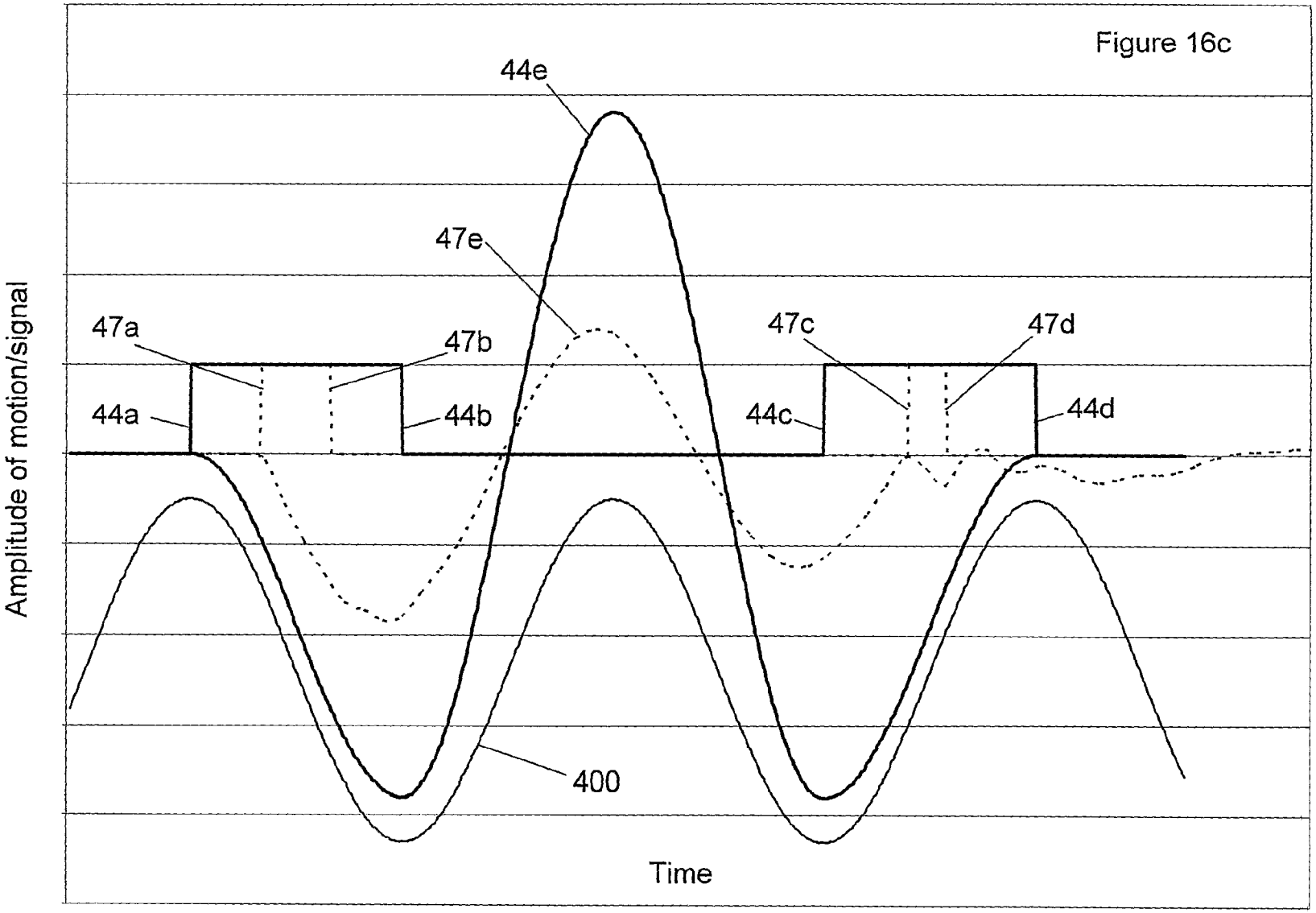

FIG. 16*a* illustrated the how the timings of the voltage changes are arranged to cancel the motion of the material layer for a damped and an undamped device. FIG. 16*b* illustrated how, for an undamped device, the amplitude of motion of the material layer can be reduced by varying the timings of the voltage changes. FIG. 16*c* illustrates a combination of FIGS. 16*a* and 16*b*.

FIG. 16*c* shows the voltage changes and response of the material layer for an undamped device at maximum amplitude. It also shows voltage changes 47*a*, 47*b*, 47*c* and 47*d* that are required to achieve reduced motion 47*e* in a damped device.

First rising voltage change 47*a* and first falling voltage change 47*b* occur at the same time as voltage changes 46*a* and 46*b*. In other words, whether the device is damped or not has no bearing on when the first rising and falling voltage changes are applied to achieve a reduction in amplitude of the material layer.

To cancel the motion shown by line 47*e*, a second rising voltage change 47*c* occurs at a time $t>3p/2$ and a second falling voltage change 47*d* occurs at $t<2p$ to compensate for the fact that the induced motion has been reduced by the damping, as described in relation to FIG. 16*a*. The midpoint between the second rising edge and the second falling edge occurs one and a half periods after the midpoint between the first rising edge and the first falling edge.

Figure 16D:
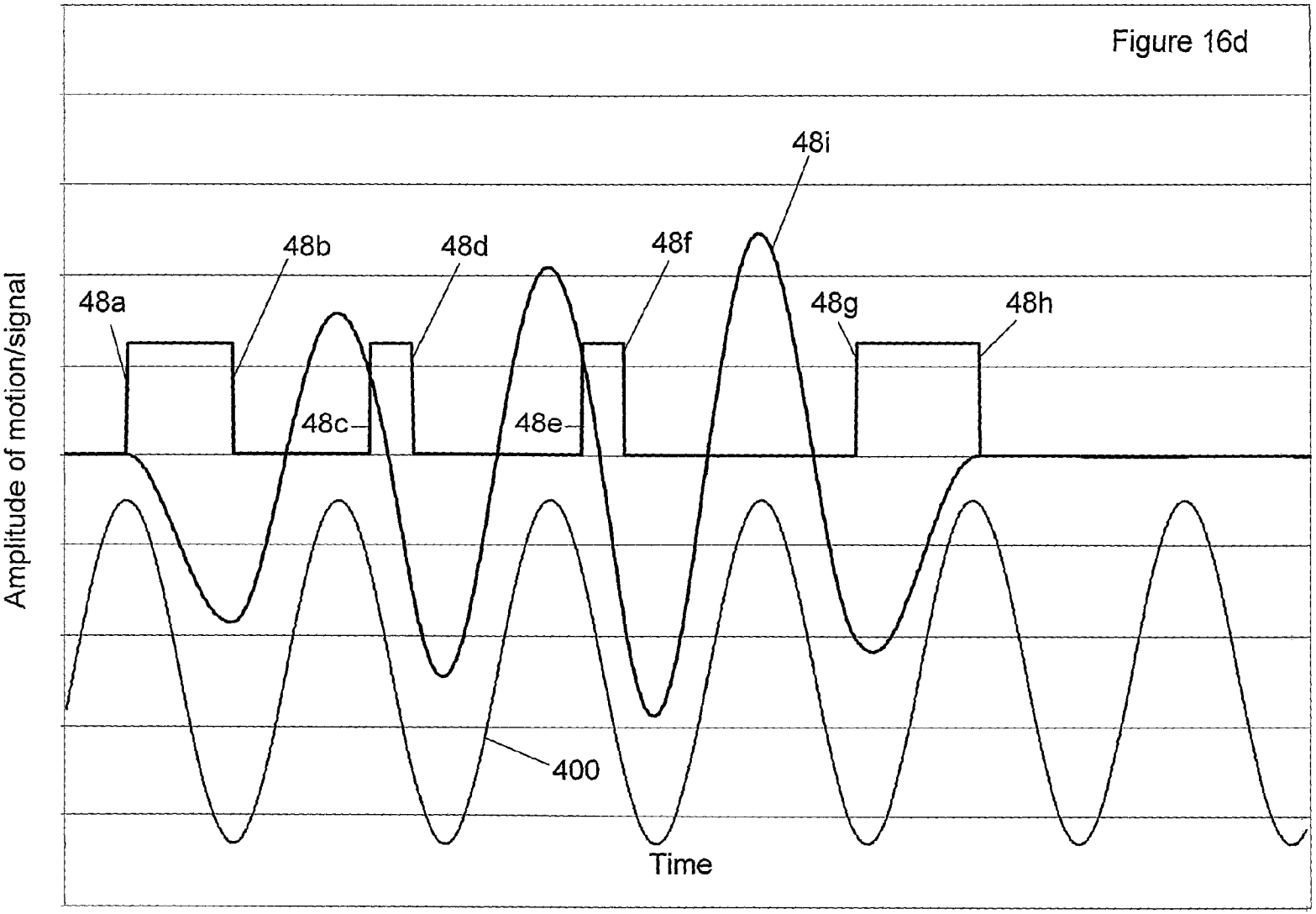
Figure 16E:
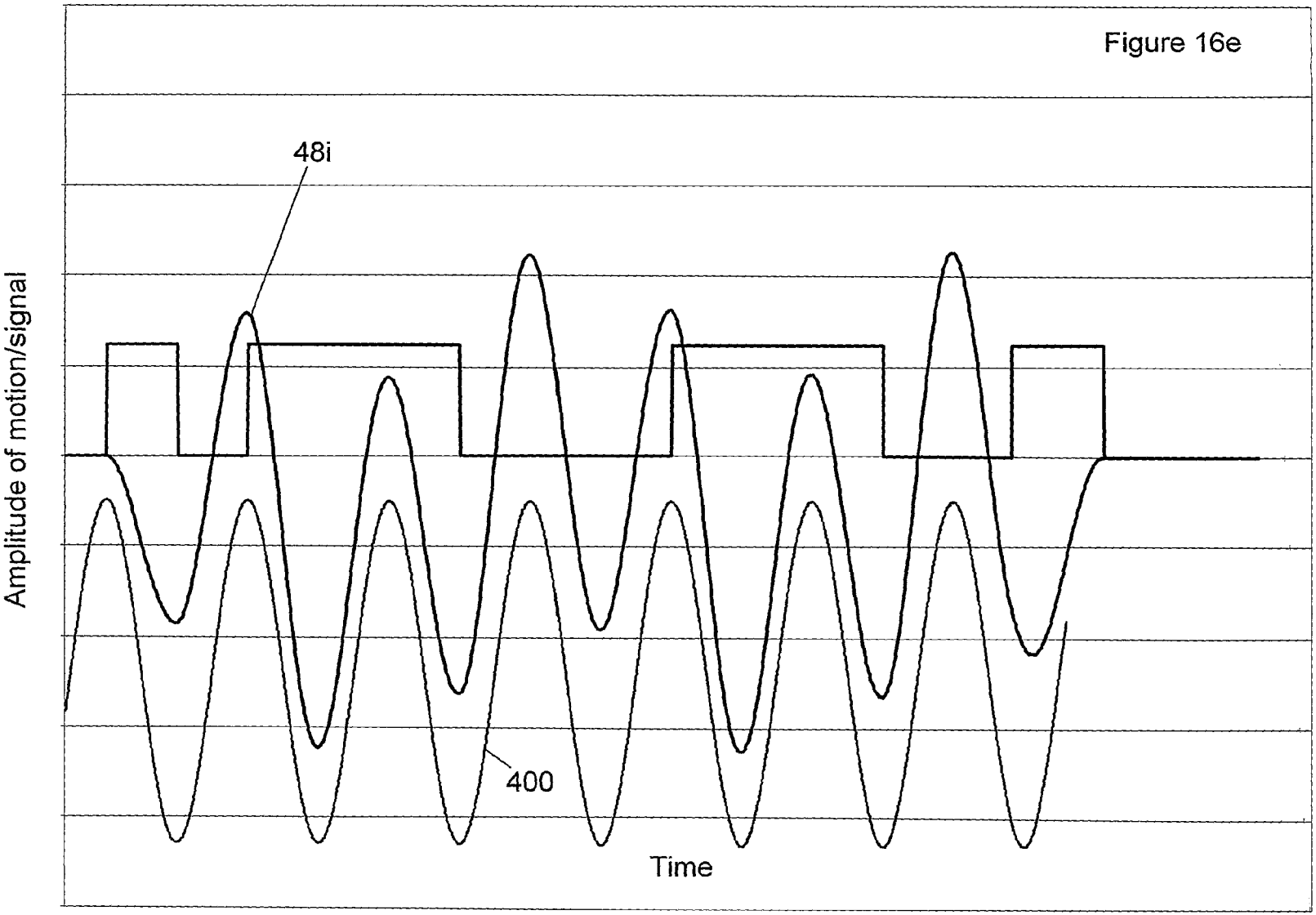

Longer sequences of reinforcing and cancelling edges can be used to eject a number of droplets at resonant frequency prior to stopping the motion. An example of such a drive scheme is shown in FIG. 16*d*. In this example six voltage changes 48*a* to 48*f* are used to generate three oscillations. The motion of the damped device to the voltage changes is shown in line 48*i*. These oscillations increase in amplitude so producing three drops of increasing velocity which will thus coalesce in flight. Then two voltage changes 48*g* and 48*h* are used to cancel the motion. In the previous examples the cancelling edges were less than p/2 apart, however the motion can also be cancelled by placing the cancelling edges more than p/2 apart. In this case 48*g* and *h* occur at $<7p/2$ and $>8p/2$. If the damping of the fingers was increased or the pulse timing was altered this drive scheme, with a correctly adjusted cancelling pulse, could be used to generate three drops with the same velocity. A second example is shown in FIG. 16*e*. In this example six voltage changes are used to eject 6 drops and then two voltage changes are used to cancel the motion. In this example more drops are produced using the same number of voltage changes as that used in the example shown in FIG. 16*d*.

The residual motion of the material layer after the cancellation pulses is a combination of any other modes of the device, the error in how accurately the decay constant is known and the error in how accurately the resonant frequency of the device is known. The amount of residual motion is less sensitive to errors in how accurately the frequency is known when the damping coefficient is larger. Thus in order to reduce this sensitivity the damping coefficient could be raised. This could be achieved in a number of ways for example: (i) bonding a lossy material to one surface of the actuator or material layer; (ii) making the material layer out of a lossy material; and (iii) placing a rigid surface close to, but not in contact with, a portion of the ink side of the material layer or actuator, there by creating a small gap which is lossy as fluid is forced in and out of the gap by the motion of the material layer.

When a first finger is driven to cause ejection of its associated nozzle, the neighbouring fingers also induced to move slightly. If the neighbouring fingers are driven in order to cause ejection from their associated nozzles at some later time, then the ejection velocity will be altered if those neighbouring fingers still have some residual motion before they are driven. This means that the neighbouring finger cannot be used for a certain period after the first finger has been driven, while the induced motion is allowed to decay. This restricts the ejection speed that can be achieved.

Figure 16F:
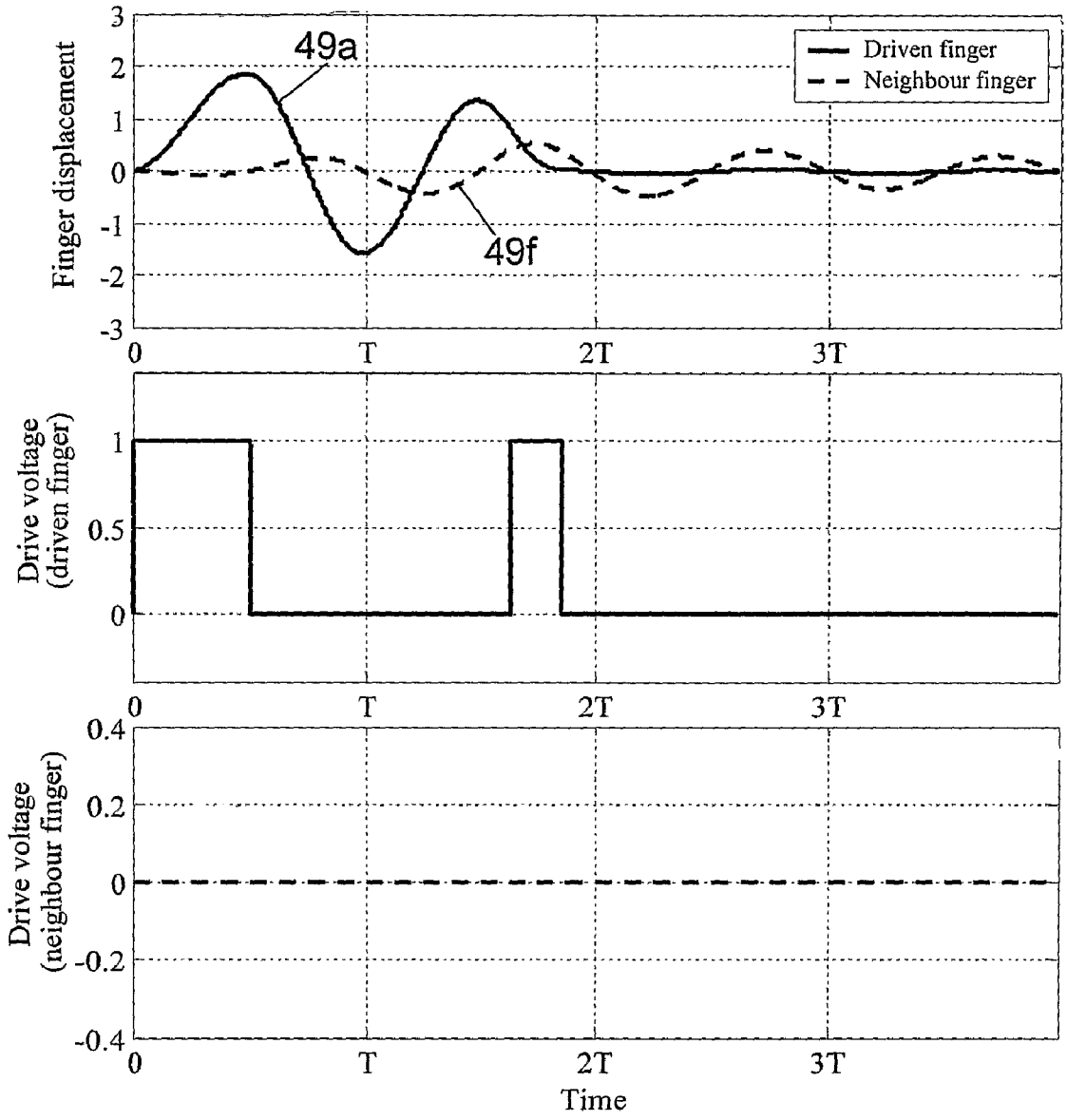

FIG. 16*f* illustrates this effect. A drive voltage scheme as shown in FIG. 16*a* is applied to the driven finger and no drive voltage is applied to the neighbouring finger(s). The line 49*a* shows the resulting motion of the ejecting finger and the line 49*b* shows a typical motion induced in the neighbouring finger(s). As can be clearly seen, the motion in the driven finger is cancelled in the same manner as shown in FIG. 16*a*, but the motion in the neighbouring finger(s) decays slowly.

Figure 16G:
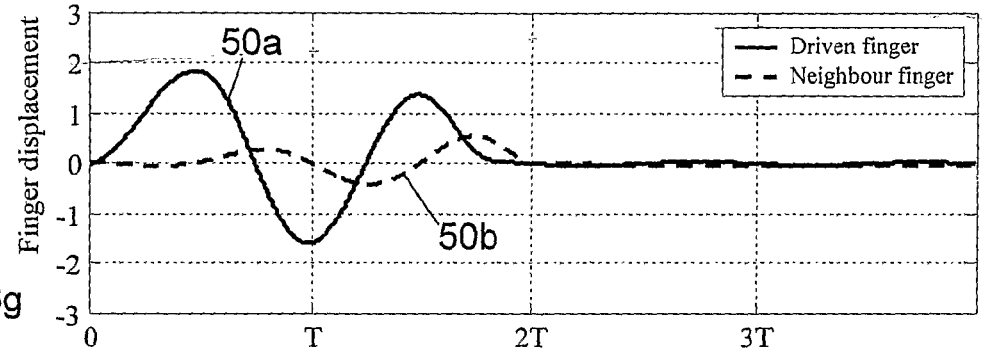
Figure 16H:
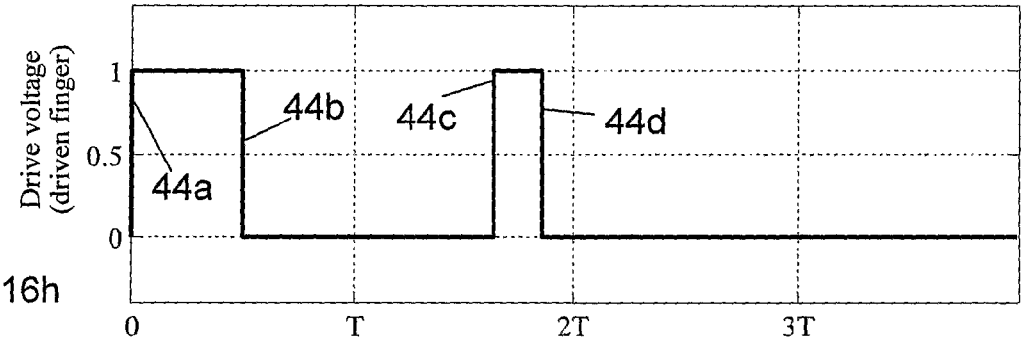
Figure 16I:
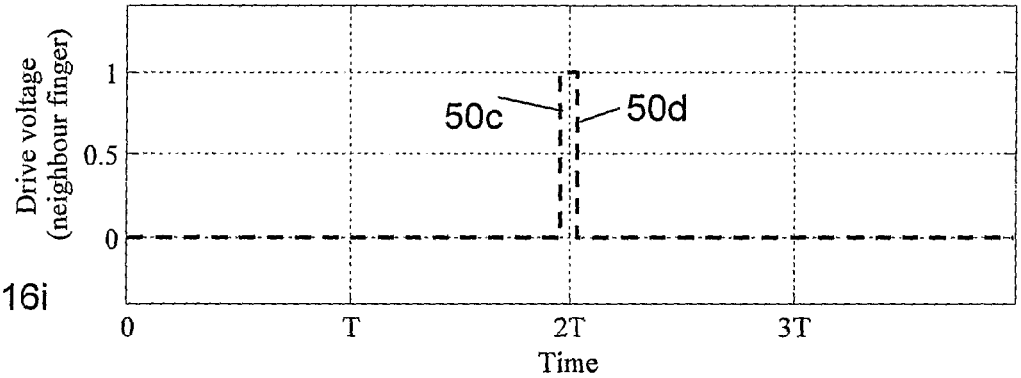

FIGS. 16*g*, 16*h* and 16*i* show how a drive signal is applied to a neighbouring finger in order to cancel the motion that it is induced in it. FIG. 16*g* shows the resulting motion 50*a* of the ejecting finger and that the typical motion 50*b* induced in the neighbour is cancelled. FIG. 16*h* shows a drive signal which comprises the drive scheme as shown in FIG. 16*a* applied to the ejecting finger. FIG. 16*i* shows the cancelling signal (or voltage pulse) applied to the neighbouring finger which comprises a rising voltage change 50*c* and a falling voltage change 50*d*.

If the fluid to be ejected is treated as being incompressible, the cancelling pulse 50*c*, 50*d* must be centred around the time 3/4p, 7/4p or 11/4p after the centre of the first pulse 44*a*, 44*b*. In practice the compressibility of the fluid will mean that the cancelling pulse 50*c*, 50*d* will need to be fractionally later than this, by a duration whose magnitude is of the order of the time taken for a compressible pressure wave to propagate from the ejecting finger to the neighbouring finger through the liquid on the inner face of the material layer, where compressible pressure waves travel for example in aqueous fluids at around 1000 meters per second. The duration of the pulse will depend on the geometry of the system and the damping coefficient of the fingers.

FIG. 17 shows three neighbouring independently actuated regions of material layer 100*a*, 100*b* and 100*c*. The material layer regions 100*a*, 100*b* and 100*c* are driven with different motion, to project liquid from their respective nozzles 13*a*, 13*b* and 13*c*, depending on whether adjacent nozzles are ejecting liquid at the same time. As explained above, the driving of one finger that is excited to project liquid from its associated nozzle will cause pressure fluctuations in the liquid behind its neighbouring nozzles, and therefore the ejected droplet's properties are functions of both the motion of the material layer surrounding the ejecting nozzle and that surrounding the neighbouring nozzles.

The motion with which finger 13*b* moves, if nozzle 13*b* is ejecting liquid at the same time as nozzle 13*a*, will not need to be as great as the motion required if nozzle 13*b* is ejecting alone.

The increase in pressure under a region of material layer as a result of the pressure generated under a neighbouring material layer region is shown in FIG. 11 as a function of the slot width (s) expressed as a fraction of the finger width (L).

It is desirable to ensure that the properties of the drop ejected from a nozzle 13 such as drop volume and velocity are independent of whether or not drops are ejected by neighbouring nozzles. This is achieved by adjusting the motion of the material layer surrounding the ejecting nozzle in such a way so as to compensate for the motion of the material layer surrounding neighbouring nozzles.

In order to compensate for the pressure produced by the motion of neighbouring regions of material layer, the motion of a finger is reduced when neighbouring fingers are also ejecting. This can be achieved either by changing the voltage of the drive scheme or by changing the degree to which the driving voltage changes reinforce the material layer motion. In both cases, compensation can be applied either using predetermined variations in the drive scheme, or using feedback from a sensor.

A nozzle may have more than two neighbouring nozzles, for instance the nozzles may be provided in a two-dimensional array. In this case, if say a first nozzle has three neighbouring nozzles which are simultaneously ejecting, the amplitude of motion of the finger associated with the first nozzle is reduced even further than when only one (or two) neighbouring nozzle(s) is(are) simultaneously ejecting.

Each of the examples described above could usefully confer benefit in all application fields including, but not restricted to: an inkjet printer, an office printer, to image a printing plate to function as an offset master, to print onto packaging, to directly mark food stuffs, to mark paper for example to generate receipts and coupons, to mark labels and decals, to mark glass, to mark ceramics, to mark metals and alloys, to mark plastics, to mark textiles, to mark or deposit material onto integrated circuits, to mark or deposit material onto printed circuit boards, to deposit pharmaceuticals or biologically active material either directly onto human or animal or onto a substrate, to deposit functional material to form part of an electric circuit, for example to alter or generate an RFID tag, an aerial or a display.

The invention claimed is:

1. A method of projecting liquid as jets or droplets from a nozzle provided on a transducer formed by a region of a material layer, the method comprising the steps of:

supplying liquid to an inner end of the nozzle;

exciting the nozzle to cause movement of the nozzle in a direction substantially aligned with the nozzle axis in order to project liquid as a droplet from an outer face of the nozzle;

wherein the step of exciting the nozzle comprises sequentially driving the transducer with a first rising voltage change, a first falling voltage change, a second rising voltage change and a second falling voltage change;

wherein the first rising voltage change and the first falling voltage change are timed so that they enhance the movement of the material layer, and the second rising voltage change and the second falling voltage change are timed so that they substantially cancel the movement of the material layer;

wherein the movement of the material layer following any edge is mono-modal; and wherein the duration between the first rising voltage change and the first falling voltage change is up to half a period of the movement of the material layer.

2. A method according to claim 1, wherein the midpoint in time between the first rising voltage change and the first falling voltage change is 1.5 periods of the movement of the material layer before the midpoint in time between the second rising voltage change and the second falling voltage change such that the combination of the voltage changes and the damping of the device substantially cancel the motion of the material layer.

3. A method according to claim 1, wherein multiple reinforcing voltage changes are applied to cause ejection of a number of droplets, followed by multiple cancelling voltage changes to substantially stop the motion of the material layer.

4. A method according to claim 1 wherein a plurality of nozzles are provided, each nozzle being provided on an associated transducer, the method further comprising the step of:

exciting a neighbouring nozzle with a rising voltage change and a falling voltage change timed in order to substantially cancel the movement of the neighbouring nozzle induced by the excited nozzle.

5. A method according to claim 4, wherein the midpoint in time between the rising voltage change and the falling voltage change applied to the neighbouring nozzle is just later than 0.75 periods of the movement of the material layer after the midpoint in time between the first rising voltage change and the first falling voltage such that motion of the neighbouring nozzle induced by the excited nozzle is substantially cancelled.

6. A method according to claim 4, wherein the midpoint in time between the rising voltage change and the falling voltage change applied to the neighbouring nozzle is just later than 1.75 periods of the movement of the material layer after the midpoint in time between the first rising voltage change and the first falling voltage such that motion of the neighbouring nozzle induced by the excited nozzle is substantially cancelled.

7. A method according to claim 4, wherein the midpoint in time between the rising voltage change and the falling voltage change applied to the neighbouring nozzle is just later than 2.75 periods of the movement of the material layer after the midpoint in time between the first rising voltage change and the first falling voltage such that motion of the neighbouring nozzle induced by the excited nozzle is substantially cancelled.

8. A method according to claim 1 wherein a plurality of nozzles are provided on the material layer and each nozzle has an associated transducer, the method comprises the steps of:

supplying liquid to the inner face of each nozzle;

exciting the nozzles with respective transducers, to cause movement of the nozzles in a direction substantially aligned with the nozzle axis;

selectively exciting transducers as required, thereby to project liquid as jets or droplets from the respective outer face by movement of the liquid through the nozzle in response to the movement of the nozzle;

exciting each nozzle with the voltage changes so that it is driven at a first amplitude of motion in order to project liquid when the neighbouring nozzle(s) is (are) not projecting liquid, and exciting the nozzle with the voltage changes so that it is driven at a second amplitude of motion when a neighbouring nozzle is simultaneously projecting liquid;

and wherein the second amplitude of motion is smaller than the first amplitude of motion.

9. A method according to claim 8, wherein the nozzle is excited with the voltage changes so that it is driven at a third amplitude of motion when at least two neighbouring nozzles are simultaneously projecting liquid;

and wherein the third amplitude of motion is smaller than the second amplitude of motion.

10. A method according to claim 8, wherein each nozzle is driven with a signal of a first amplitude so that it is driven at the first amplitude of motion when a neighbouring nozzle is not projecting liquid and the nozzle is driven with a signal of second amplitude so that it is driven at the second amplitude of motion when a neighbouring nozzle is simultaneously projecting liquid;

and wherein the signal of the second amplitude is smaller than the signal of the first amplitude.

11. A method according to claim 10, wherein each nozzle is driven with a signal of a third amplitude so that it is driven at the third amplitude of motion when at least two neighbouring nozzles are simultaneously projecting liquid;

and wherein the signal of the third amplitude is smaller than the signal of the second amplitude and the signal of the second amplitude is smaller than the signal of the first amplitude.

12. A method according to claim 9, wherein the first falling voltage change is applied at a first predetermined time period after the first rising voltage change so that the nozzle is driven at the first amplitude of motion, and the first falling voltage change is applied at a second predetermined time period after the first rising voltage change so that the nozzle is driven at the second amplitude of motion when a neighbouring nozzle is simultaneously projecting liquid.

13. A method according to claim 12, wherein the first predetermined time period is closer to half the period of motion of the resonant frequency of the device than the second predetermined time period.

14. A method according to claim 12, wherein the first falling voltage change is applied at a third predetermined time period after the first rising voltage change so that the nozzle is driven at the third amplitude of motion when both neighbouring nozzles are simultaneously projecting liquid.

15. A method according to claim 14, wherein the second predetermined time period is closer to half the period of motion of the resonant frequency of the device than the third predetermined time period.

16. A method according to claim 2 wherein a plurality of nozzles are provided on the material layer and each nozzle has an associated transducer, the method comprises the steps of:

supplying liquid to the inner face of each nozzle;

exciting the nozzles with respective transducers, to cause movement of the nozzles in a direction substantially aligned with the nozzle axis;

selectively exciting transducers as required, thereby to project liquid as jets or droplets from the respective outer face by movement of the liquid through the nozzle in response to the movement of the nozzle;

exciting each nozzle with the voltage changes so that it is driven at a first amplitude of motion in order to project liquid when the neighbouring nozzle(s) is (are) not projecting liquid, and exciting the nozzle with the voltage changes so that it is driven at a second amplitude of motion when a neighbouring nozzle is simultaneously projecting liquid;

and wherein the second amplitude of motion is smaller than the first amplitude of motion.

17. A method according to claim 3 wherein a plurality of nozzles are provided on the material layer and each nozzle has an associated transducer, the method comprises the steps of:

supplying liquid to the inner face of each nozzle;

exciting the nozzles with respective transducers, to cause movement of the nozzles in a direction substantially aligned with the nozzle axis;

selectively exciting transducers as required, thereby to project liquid as jets or droplets from the respective outer face by movement of the liquid through the nozzle in response to the movement of the nozzle;

exciting each nozzle with the voltage changes so that it is driven at a first amplitude of motion in order to project liquid when the neighbouring nozzle(s) is (are) not projecting liquid, and exciting the nozzle with the voltage changes so that it is driven at a second amplitude of motion when a neighbouring nozzle is simultaneously projecting liquid;

and wherein the second amplitude of motion is smaller than the first amplitude of motion.

* * * * *